US005630563A

United States Patent [19]

Meisner et al.

[11] Patent Number: 5,630,563

[45] Date of Patent: May 20, 1997

[54] APPARATUS FOR DISPENSING A CONTROLLED LENGTH OF SHEET MATERIAL FROM A ROLL

[75] Inventors: Edward H. Meisner, Short Hills; Michael P. Ballone, New Providence, both of N.J.

[73] Assignee: Reynolds Metals Company, Richmond, Va.

[21] Appl. No.: 463,901

[22] Filed: Jun. 5, 1995

[51] Int. Cl.[6] ..... B26F 3/02

[52] U.S. Cl. ..... 242/598.6; 225/43; 225/47

[58] Field of Search ..... 242/396, 396.1, 242/396.2, 396.4, 405, 405.3, 421.8, 598.5, 598.6; 206/397, 407, 408, 409, 53; 225/43, 46, 47, 51, 52

[56] References Cited

U.S. PATENT DOCUMENTS

| | | | |
|---|---|---|---|
| 554,769 | 2/1896 | Brownell . | |
| 1,366,241 | 1/1921 | Burch . | |
| 2,115,867 | 5/1938 | McConnell | 225/46 |
| 2,253,744 | 8/1941 | Witt | 225/43 |
| 2,334,997 | 11/1943 | Doll | 206/58 |
| 2,381,229 | 8/1945 | Shalhoub | 225/47 |
| 2,512,168 | 6/1950 | Moore | 206/59 |
| 2,783,878 | 3/1957 | Traver | 206/52 |
| 2,825,451 | 3/1958 | Henry | 206/58 |
| 2,857,046 | 10/1958 | Klein | 206/58 |
| 2,889,975 | 6/1959 | Hanlon | 225/47 |
| 2,893,616 | 7/1959 | Stell | 225/52 |
| 2,948,575 | 8/1960 | Kellman et al. . | |
| 2,978,156 | 4/1961 | Yaniello | 225/46 |
| 3,142,426 | 7/1964 | Busse | 225/43 |
| 3,679,110 | 7/1972 | Stine | 225/47 |
| 3,698,548 | 10/1972 | Stenzel et al. | 242/598.6 |
| 3,739,964 | 6/1973 | Stine | 225/47 |
| 3,991,878 | 11/1976 | Serio, Jr. et al. . | |
| 4,119,251 | 10/1978 | Golner et al. | 225/20 |
| 4,244,503 | 1/1981 | Kramer | 225/46 |
| 4,401,248 | 8/1983 | Helms | 225/47 |
| 4,417,495 | 11/1983 | Gordon et al. | 225/43 |
| 5,222,681 | 6/1993 | Loewe et al. | 206/409 |
| 5,383,590 | 1/1995 | Ho | 225/43 |
| 5,425,486 | 6/1995 | Kurker | 225/51 |

*Primary Examiner*—John P. Darling
*Attorney, Agent, or Firm*—Alan T. McDonald

[57] ABSTRACT

A roll of sheet material is wound on a cylindrical hollow core, and the core and roll are together placed within a dispenser body made up of pivotally connected upper and lower covers, preferably made of a resilient plastic material and sized and shaped to provide a containment space for a full roll of sheet material. The core and roll wound thereon can be placed into the lower cover in only one direction, so that rotation of the rolled-up sheet material must occur only in a corresponding one rotational direction for unwinding of the sheet material from the roll. The upper and lower covers are formed so that there is a built-in resilient force exercised by one or the other so as to keep them pivotally separated apart. A detent mechanism is provided to limit the amount by which the two covers can thus pivotally separate during use. By their pivotal separation, the covers define a small forward gap through which the sheet material may be withdrawn. When a user has extracted a sufficient length of sheet material, he or she may press the covers to each other to thereby stop further rotation of the roll. A conventional, preferably serrated, cutting edge is provided at a forward edge portion of the lower cover, and withdrawn sheet material may be torn off by being forced thereon.

97 Claims, 14 Drawing Sheets

FIG. 1A
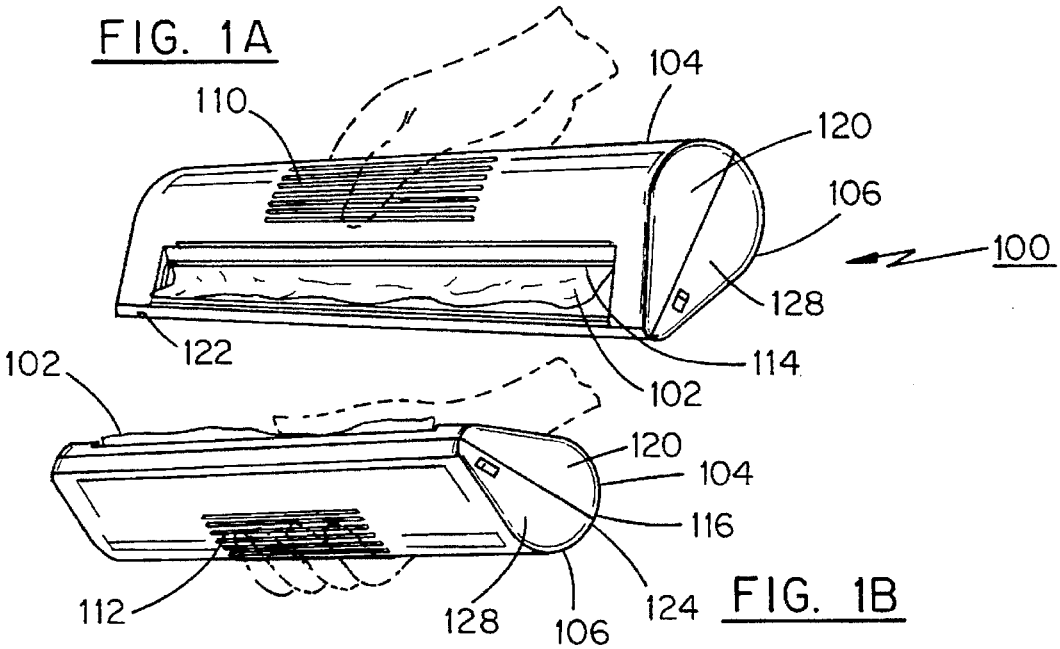
FIG. 1B
FIG. 2
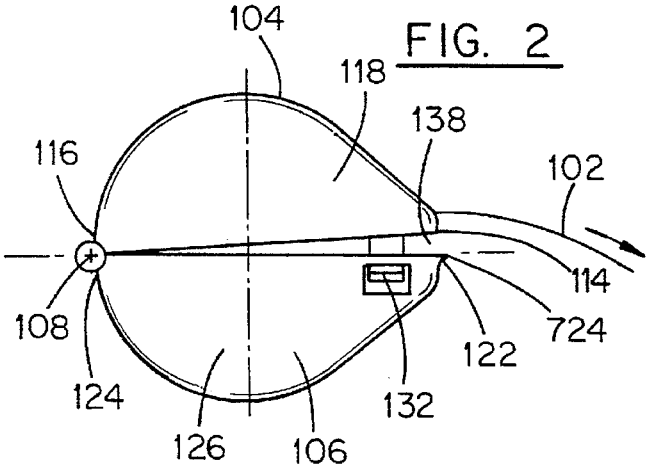
FIG. 3
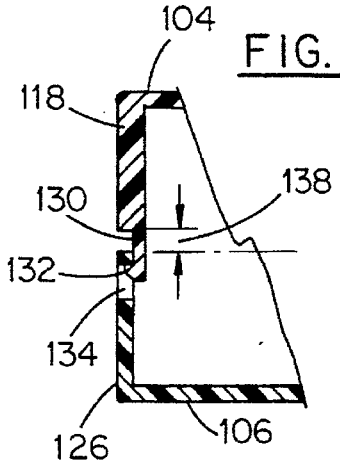
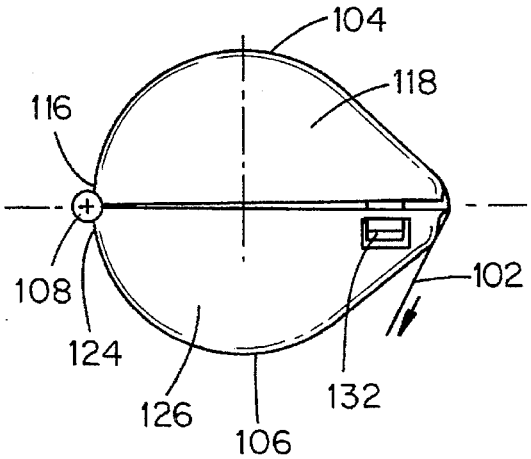
FIG. 4
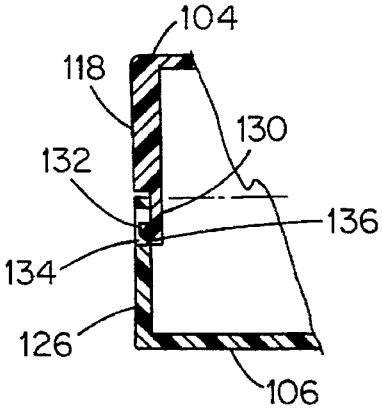
FIG. 5

X
4002
118
110
102
114
726
104

3396
138
112
106

3300
4500

APPARATUS FOR DISPENSING A CONTROLLED LENGTH OF SHEET MATERIAL FROM A ROLL

TECHNICAL FIELD

This invention relates to apparatus for dispensing a length of a sheet material from a roll thereof wound on a hollow core, and more particularly to apparatus by which a user can conveniently unroll a sheet material from a roll thereof and precisely stop the unrolling to conveniently tear off a selected length of the sheet and be able to easily access the cut end of the rolled sheet material to unroll and obtain another length thereof.

BACKGROUND ART

Various materials of elongate sheet form are frequently stored on hollow core members as tightly wound rolls, and the rolls are rotatably contained within light and easy-to-handle containers from which the user may extract a suitable length and tear it off the roll as needed. Well-known examples of such sheet material include thin, clear plastic wrap to cover stored food such as fruit, vegetables and sandwiches, or thin aluminum foil for wrapping food for storage or during cooking. The dispenser is usually sized to be only somewhat larger than a full roll, i.e., one on which a maximum predetermined length of the sheet material is wound tightly prior to use of any unwound material.

The dispenser may be mounted at a convenient location, so that one or more users may obtain as much of the sheet material as they each need. More often, however, it is desired that the dispenser with the roll contained within be small, light, and shaped for being easily held in one hand with easy access to a distal end of the sheet afforded to the user's other hand, with the dispenser being formed to allow easy control over the length of sheet material being withdrawn therefrom.

The roll of sheet material often is simply placed into a cubical box formed by making various folds in a generally two-dimensional sheet of cardboard. An elongate slit or gap between adjacent or overlapping end portions of the container material provides an outlet for the sheet material being unrolled from the roll. An example of this is taught in U.S. Pat. No. 2,825,451, to Henry, titled "Dispensing Carton for Rolled Sheet Material."

A cutting edge, preferably one which has a serrated edge or roughened surface, is generally provided close to the slit or gap through which the sheet material is being extracted so as to enable the user to cause forcible contact between the sheet material and the cutting edge. An example of such a device is the one taught in U.S. Pat. No. 5,383,590, to Ho, titled "Safety Food Wrap Film Tearing Device".

When the roll is simply placed inside a container, with no provision for positively stopping the roll, due to rotational inertia of the rotating roll itself there is often surplus material withdrawn and the user may end up wasting it. It is therefore desirable to provide a way to stop unnecessary unrolling of the material from the roll. Examples of known devices to accomplish this include U.S. Pat. No. 2,512,168, to Moore.

It is also desirable to prevent rotational recoil of the roll and consequential unintentional rewinding of the distal end of the material back on the roll. Examples of prior art addressing this problem include U.S. Pat. No. 2,857,046, to Klein, titled "Dispensing Containers for Sheet Wrapping Material" and U.S. Pat. No. 2,948,575, to Kallman et al., also titled "Dispensing Container for Sheet Wrapping Material".

There are also known structures in which the dispenser includes a pivotable cover which is generally biased so as to form an opening at a front edge of the cover, with the shape of the container being such as to enable a user to overcome the bias to narrow the opening to facilitate convenient application of the withdrawn length of sheet to a cutting edge provided along and adjacent to the opening. The cutting edge preferably has an elongate sequence of serrations. Typically, these can be contacted by the user and, in careless use, may scratch or cut the user's skin. U.S. Pat. No. 2,893,616, to Stell, titled "Web Dispenser", is an example of such prior art. Also known are dispensers, typically formed of folded thin cardboard material, which are provided with means cooperating with the open ends of a hollow cardboard roll on which the sheet material is wound, to rotatably support the roll substantially centrally of the dispenser body. Examples of prior art relating to such dispensers are described in U.S. Pat. No. 2,825,451, to Henry, titled "Dispensing Carton for Rolled Sheet Material"; U.S. Pat. No. 3,679,110, to Stine, titled "Cutter-Type Box for Dispensing Packaging Film With Protective Mounting for the Cutter"; U.S. Pat. No. 3,739,964, also to Stine, titled "Cutter-Type Box for Dispensing Packaging Film"; and U.S. Pat. No. 3,991,878, to Serio, Jr. et al., titled "Roll End Support and Dispensing Carton".

There is, however, a still unmet need for apparatus or a mechanism by which a user may very quickly and easily place a roll of sheet material wound on a hollow core into a relatively light, inexpensive, easy-to-grasp, and non-slip dispenser body with the assurance that the entire dispenser containing the roll can be conveniently held in one hand while the other hand has ready access to a distal end of the rolled sheet to allow: extraction of a desired length of the material, easy stoppage of the roll when the desired length has been withdrawn, ready limitation of an opening of the dispenser to ensure against ingress of ambient dirt and dust into the dispenser and to facilitate location of the sheet in relation to a cutting edge to facilitate tearing off of the desired length, protection against cuts and abrasions of the user's fingers due to contact with sharp cutting edge serrations during handling of the dispenser, and prevention of unintended roll-back of the roll so that future access to the distal end for further extraction of material is rendered easy. For reasons of cost, convenience of manufacture, aesthetic appeal and convenience of use, moldable plastics materials are the preferred choice both for forming the dispenser body and for other elements which must cooperate therewith to achieve the desired objectives.

The present invention provides various embodiments of such an invention, all of which meet this long-felt need, as will be understood from the following description with reference to the drawing.

DISCLOSURE OF THE INVENTION

A principal object according to one aspect of this invention is to provide means by which a roll of sheet material wound on a hollow core may be readily disposed inside an inexpensive, light, and easy-to-grasp dispenser to allow a user to unroll and withdraw from the container selected lengths of the sheet material with easy and assured subsequent access to a distal end of the remaining material on the roll.

A related object of this aspect of the invention is to provide an inexpensive plastic element, which can be readily fitted to a conventional hollow elongate core on which a length of sheet material is wound to form a compact roll, to enable disposition of the roll inside a dispenser body in such a manner that a user can readily control the repeated extraction of lengths of sheet material out of the dispenser from the roll.

In another aspect of this invention, it is a principal object to provide a dispenser apparatus having a light, inexpensive, easy-to-grasp and non-slip body within which may be placed a readily replaceable roll of sheet material wound on a hollow elongate core, the dispenser body being operable to facilitate controlled extraction of selected lengths of the sheet material.

It is another related object of this aspect of the invention to provide an inexpensive and readily held dispenser body which a user can conveniently hold in one hand, in cooperation with the other hand pull on a distal end of the sheet material to control the length of sheet material being withdrawn, and locate the sheet material to facilitate tearing thereof at a cutting edge on the dispenser body with protection provided against cuts and abrasions of the user's hand due to contact with the cutting edge.

These and other related objects of this invention are realized by providing, in the first aspect of this invention, apparatus permanently affixed to one end of a hollow core on which a length of sheet material is compactly wound, to allow a user to readily place the roll in a singular manner inside a readily opened reclosable dispenser body so that the roll is rotatably supported within the dispenser, such that the distal end of the sheet material on the roll is readily accessed and withdrawn from an elongate opening of the dispenser with rotation of the roll controlled to limit the length of sheet material that is withdrawn.

In another aspect of the invention, there is provided a dispenser body for containing a replaceable roll of a sheet material and for enabling controlled removal of selected lengths of the sheet material from a roll thereof wound on a hollow core having respective first and second ends. The dispenser body includes an upper cover which is pivotally connected to a lower cover, the two covers each comprising an elongate wall having front and rear edges, and transverse first and second end walls. The upper and lower covers are each shaped and sized to cooperate to define a containment space within which the roll wound on the core can be contained. A free end of the sheet material unwound from the roll is extractable through an elongate material delivery gap of adjustable width formed between the front edges of the upper and lower covers. First and second means located inside the containment space within the dispenser body are provided respectively adjacent to both the first and second end walls of the two covers to support corresponding first and second ends of the core. A biasing means is provided to resiliently bias the upper and lower covers pivotally apart, and a separation limiting means is included for limiting an extent of such pivotal separation. In addition, a rotation controlling means is provided to selectively stop rotation of the core to thereby limit the length of sheet material unrolled from the roll via the delivery gap.

Other aspects and objects of this invention, in its different embodiments, will be better understood from the following detailed description which should be read with reference to the attached drawing figures.

BRIEF DESCRIPTION OF DRAWINGS

FIGS. 1A and 1B are perspective views showing an exemplary two-part hand-held dispenser body according to this invention, to explain how a right-handed person may grasp textured non-slip portions of the upper and lower covers which together comprise the dispenser body.

FIGS. 2 and 3, respectively, are end and partial longitudinal cross-sectional views of the dispenser body according to FIG. 1, with the upper and lower covers biased apart.

FIGS. 4 and 5, respectively, are end and partial longitudinal cross-sectional views corresponding to FIGS. 2 and 3, with the upper and lower covers pressed to each other.

BEST MODE FOR CARRYING OUT THE INVENTION

Figure 6:
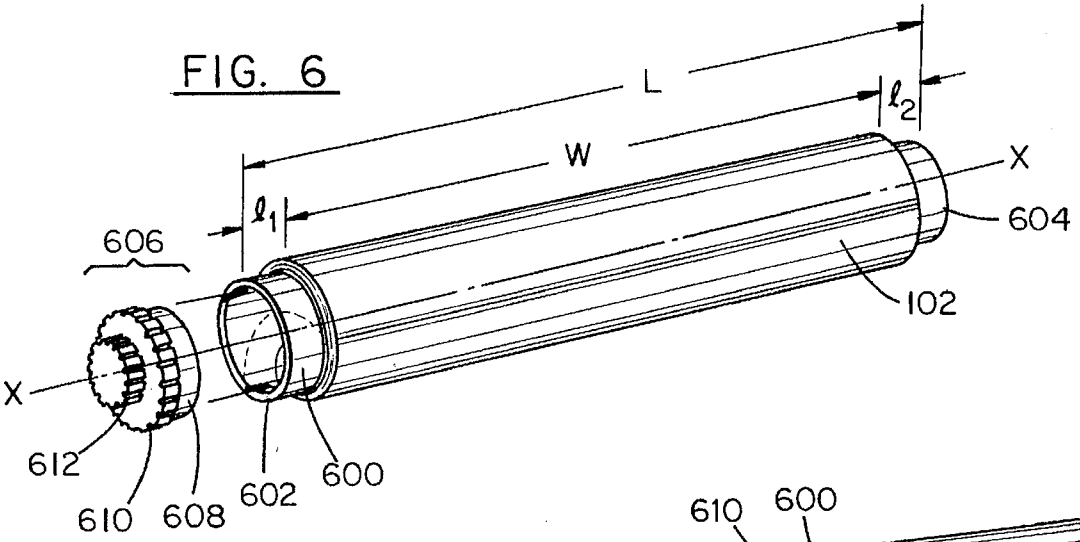
FIG. 6 is an exploded perspective view of the principal elements of a roll of sheet material according to the first embodiment of this invention.

As best seen in FIGS. 1A and 1B, the present invention relates to a hand-held dispenser having a body 100 from which a user may draw a selected length from a roll of a sheet material 102. Elongate body 100 is formed of an upper cover 104 pivotally connected to a lower cover 106, both covers preferably being made of a suitable thermoplastic material molded or otherwise formed by any known manufacturing technique.

As best seen in FIGS. 2 and 4, upper and lower covers 104,106 may be pivotally separated about a rear hinge mechanism 108 of any known type. Preferably, each cover has a cooperating hinge-pin holding portion formed to accept one or more longitudinal metal hinge pins (not shown). Another alternative would be to form portions of the upper and lower covers 104, 106 so that they snap-fit or clip to each other elastically during assembly, to thereafter function like a conventional hinge, e.g., as in known covers for magnetic-tape cassettes and the like.

Upper and lower covers 104, 106 are preferably provided in popular colors and have generally smooth attractive outer surfaces. In addition, to facilitate non-slip gripping of the dispenser body, both covers 104, 106 are preferably provided with uneven surface portions 110, 112, respectively, which may be integrally formed in the process of molding the covers themselves. Whether the uneven surfaces are defined by a plurality of ridges, as generally illustrated in FIGS. 1A and 1B, or in any other suitable manner, e.g., by adhering a rough material, is considered a matter of design choice.

Upper cover 104 has a front edge 114, a rear edge 116, a first end wall 118, and a second end wall 120. Similarly, lower cover 106 has an elongate front edge 122, an elongate rear edge 124, a first end wall 126, and a second end wall 128. Front edge 114 of upper cover 104 is located inwardly of front edge 122 of lower cover 106 for reasons explained below.

As best seen in FIGS. 2, 3, 4 and 5, in one preferred form of the invention the first end wall 118 of upper cover 104 is formed to have a downwardly depending extension 130 ending in a hooked distal end portion 132 to serve as a first detent element. In a matching location, as part of the first end wall 126 of lower cover 106, is provided an aperture 134 which is shaped, sized, and located to serve as a second detent element which receives the hooked end portion 132. This hooked end portion 132 is preferably formed to have a slanting face 136 which is angled so that when the upper and lower covers 104, 106 are pressed to each other there is a small inward deflection of extension 130 due to sliding interaction between slanting face 136 and an inside upper edge (not numbered) of first end wall 126 of lower cover 106. Once hooked end portion 132 is thus forcibly brought into an overlapping relationship with aperture 134, extension 130 being resilient will snap back to its undeformed position. The length of extension 130 and the vertical dimension of aperture 134 are selected so that once such an engagement is made the pivotal separation between upper and lower covers 104, 106 is limited unless and until a user, e.g., by pushing with a thumb nail on hooked end portion 132 to deflect extension 130 inwardly, causes disengagement of the detent arrangement defined by cooperative action between elements 130, 132, and 134. In this manner, once upper and lower covers 104, 106 are hinged at their rear edges and the detent mechanism is engaged, a limited gap 138 is defined at the front edge portions of dispenser body 100.

The detent mechanism comprising extension 130, hooked end portion 132 thereof, and aperture 134 in the lower cover 106, is preferably replicated at the opposite end of dispenser body 100, as generally indicated in FIGS. 1A and 1B. A user might drop the dispenser body 100 with a full roll of sheet material 102 contained therein, in a manner likely to subject the two covers to relatively strong impact forces. Provision of the detent engagements at both ends would very likely prevent springing apart of upper and lower covers 104 and 106 relative to each other and would prevent fall out of the roll and unwinding and dirtying of the sheet material 102 therefrom.

Depending on the nature and rolled-up width W of the sheet material, as shown in FIG. 6, one or the other of these embodiments may be preferred by likely users. The rolled-up sheet material 102 need not necessarily be in a single thickness of the material itself, but may be in flattened tubular form, with or without transverse perforations (not shown but of a type well understood by persons of ordinary skill in the art), or may involve multiple longitudinal folds of the material with the multiple folds wound together in rolled form.

The material 102 itself may be a single plastics material, a metal foil, a multi-material combination such as metallized plastic material or a metal or plastic coated paper, or the like.

As best seen in FIG. 6, the sheet material 102 is tightly wound on a hollow cylindrical core 600, having a first end 602 and a second end 604 separated by a distance L longer than the width W of the rolled-up sheet material 102, i.e, L>W.

The above-described aspects and features of dispenser body 100, with minor modifications as explained below, are common to all five embodiments of the present invention as illustrated in FIGS. 6–45. The various embodiments have individual structural differences of form and function in certain elements. Some of these features can be incorporated from one embodiment into another, or left out, in obvious modifications of the disclosed invention.

In the first embodiment, into the first end 602 of core 600 is inserted a first core end support element 606 which comprises a first generally cylindrical portion 608 having a first diameter selected to permit a tight fit thereof into first end 602. Immediately adjacent to cylindrical portion 608 is provided a peripherally toothed second portion 610 which has a second diameter somewhat larger than that of cylindrical portion 608 and the diameter of the outer cylindrical surface of core 600. On the opposite side of portion 610 relative to cylindrical portion 608 is provided a third portion 612 which also has a toothed outer periphery and an outer diameter which is smaller than the diameter of second portion 610. Element 606 is coaxially symmetrical and, when inserted into core 600, shares a common elongate central axis X—X therewith. On opposite sides of the width W of the roll of sheet material 102 are exposed core lengths $l_1$ and $l_2$, respectively adjacent the first and second ends 602, 604 of core 600.

The first core end support element 606 is preferably adhered in place with any suitable adhesive, so that it is permanently affixed into the inside of first end 602 of core 600. The purpose in making the outer diameter of peripherally toothed portion 610 of element 606 larger than the outer diameter of core 600 is to ensure that if the roll of sheet material 102 is not wound tightly enough on core 600, and has a tendency to slide axially thereof, the left-hand end of the roll of sheet material 102 will be stopped by the material of peripherally toothed portion 610 which extends radially beyond the outer surface of core 600.

Figure 7:
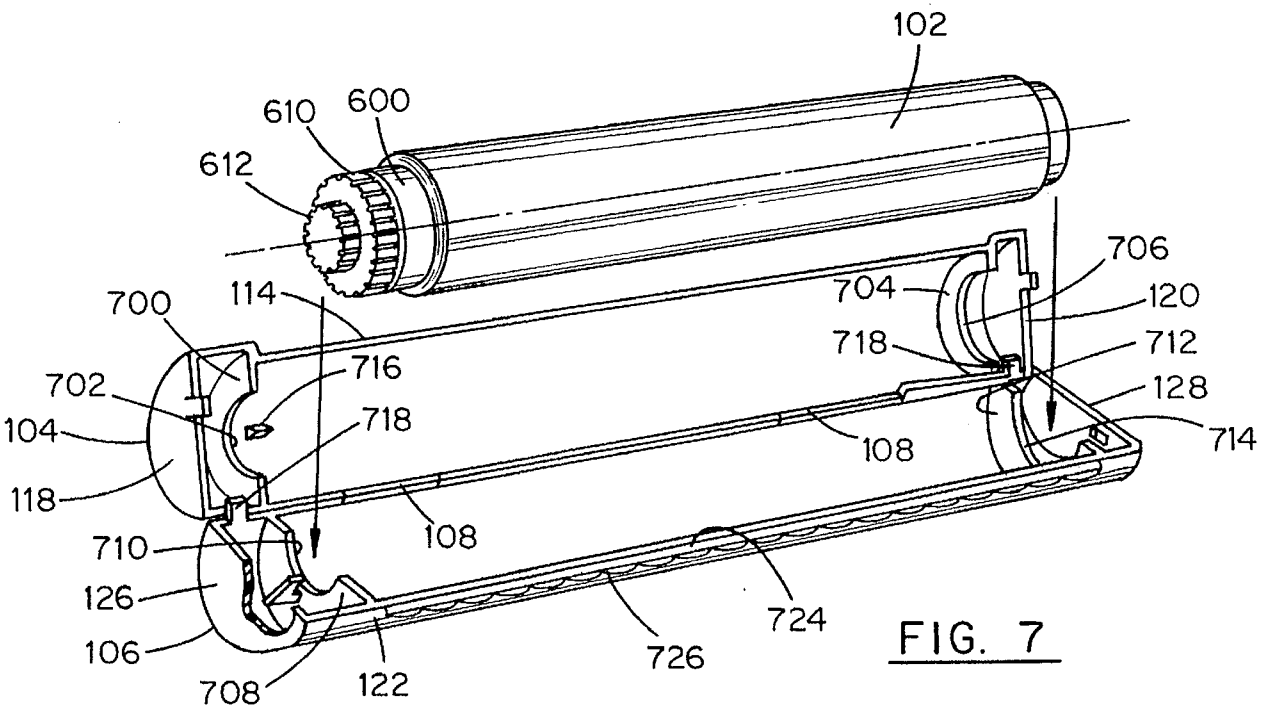
FIG. 7 is an exploded perspective view of the dispenser body and a roll according to the first embodiment, with the upper and lower covers hinged apart to enable placement of the roll.

Referring now to FIG. 7, it will be appreciated that an inside length between the respective opposed inner surfaces of the first and second end walls 118 and 120 of upper cover 104, as well as walls 126 and 128 of lower cover 106, are separated by a distance which exceeds the total of the axial length L of core 600 plus the axial lengths of portions 610 and 612 of first core end support element 606, with the entire length of portion 608 fully inserted into the first end of core 600. Also, as readily seen in FIG. 7, curved wall portions of upper and lower covers 104 and 106 each provide virtually one half of a substantially cylindrical containment space which is sized to comfortably accommodate therein the full roll of sheet material 102 tightly wound on core 604.

As best seen in FIGS. 7, 8, 9 and 11, in the first embodiment, upper cover 104 is provided with a first inner transverse wall 700 which is provided with a central cutout having a semi-circular edge 702 of a diameter slightly larger than the outer diameter of portion 612. Wall 700 is spaced axially inward of first end wall 118 by a distance sufficient to non-bindingly accommodate the axial length of portion 612. There is a similar second inner transverse wall 704 provided adjacent and inwardly of second end wall 120 of upper cover 104. Wall 704 is formed to have a cutout portion 706 having a semi-circular edge of a diameter slightly larger than the diameter of the outer surface of core 600 to non-bindingly accommodate the same even when upper and lower covers 104, 106 are pressed to each other.

Lower cover 106 is provided with its own first inner transverse wall 708 at an axial location matching that of the first inner transverse wall 700 of upper cover 104. Also, lower cover 106 is provided with a second inner transverse wall 712 located axially at a position matching that of second transverse inner wall 704 of upper cover 104. Wall 712 is provided with a cutout portion having a semi-circular edge 714 of a diameter to match that of curved edge 706 in the second transverse inner wall 704 of upper cover 104. It should be appreciated that because the curved edges 702 and 710 have diameters slightly larger than the diameter of portion 612 and because curved edges 706 and 714 similarly have diameters slightly larger than the outside diameter of core 600, even when the upper and lower covers are pressed to each other there is no binding force generated thereby to stop rotation of the core if a distal end of the material 102 is pulled through gap 138, as best seen in FIG. 8.

Figure 9:
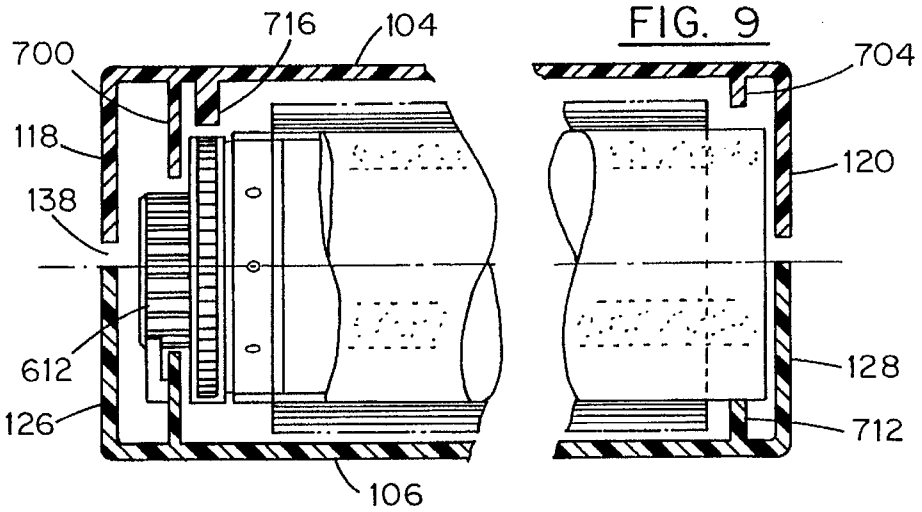
FIGS. 8 and 9 are transverse and longitudinal cross-sectional views, respectively, of the first embodiment, with the upper and lower covers biased apart.
Figure 11:
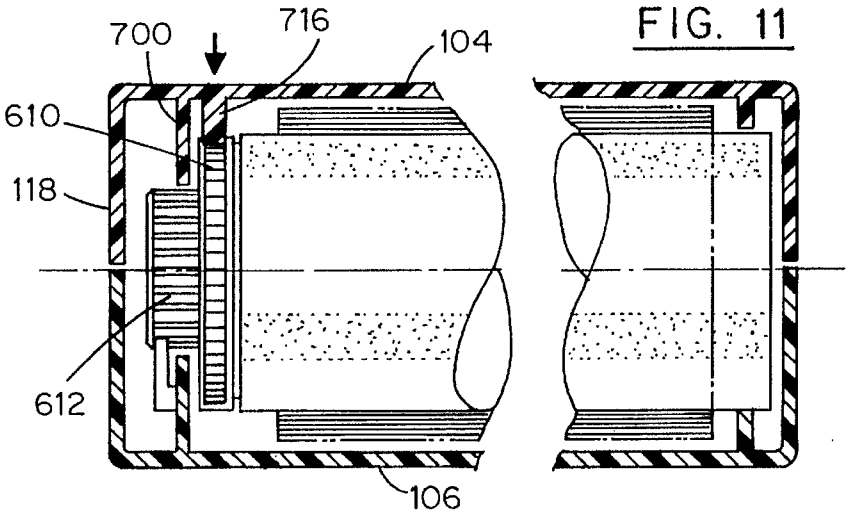
FIGS. 10 and 11 are transverse and longitudinal cross-sectional views, corresponding to FIGS. 8 and 9 respectively, with the upper and lower covers pressed to each other.

Accordingly, to ensure that there is a positive stopping of further rotation of core 600 when a sufficient length of material 102 has been unwound, there is provided in the first embodiment a radially inwardly depending rotation stoppage element 716 preferably formed integral with upper cover 104. As best seen in FIGS. 8 and 9, when upper covers 104 and 106 are pivotally separated so that gap 138 is at its maximum dimension, as determined by suitable sizing of detent elements 130, 132, and 134 as previously described, the distal end of rotation stoppage element 716 totally clears the toothed outer periphery of portion 610 of the first core end support element 606. However, as best seen with reference to FIGS. 10 and 11, when covers 104 and 106 are pivotally pressed to each other the distal end of rotation stoppage element 716 is moved to engage the toothed outer periphery of portion 610 so that it will prevent further rotation thereof. The distal end of rotation stoppage element 716 and the teeth at the outer periphery of portion 610 can be of any conventional form such that the desired engagement therebetween, by pressing together of upper and lower covers 104 and 106 to each other, is assured.

Figure 8:
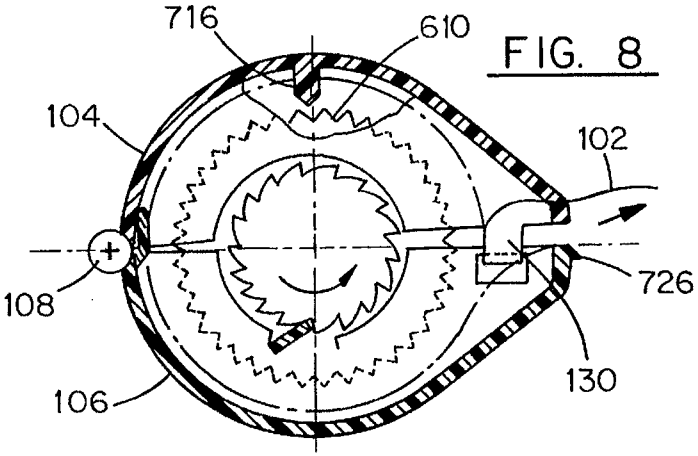
Figure 10:
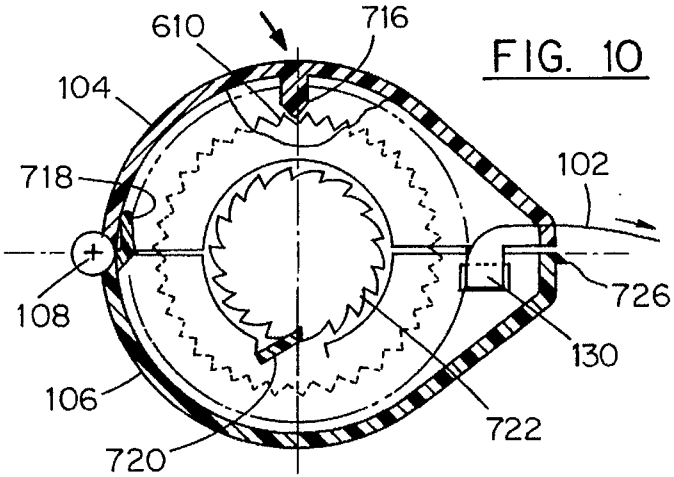

As best seen in FIGS. 7, 8 and 10, lower cover 106 preferably has integrally formed therewith two extensions 718, 718 which are shaped so that they constantly press against the inner curved surface of upper cover 104 above pivotal hinge 108 with a force sufficient to pivotally keep apart covers 104 and 106. This serves to keep gap 138 is at its maximum size. This is made possible by suitable selection of the plastics material of which lower cover 106 is formed, i.e., the material must be efficiently elastic and resilient to enable elements 718, 718 to function like leaf springs.

Covers 104, 106 will thus stay pivotally separated relative to each other under the bias force provided by elements 718, 718, but when the user presses the covers to each other, as generally indicated in FIGS. 1A, 1B and 4, the resilient bias force provided by elements 718, 718 is temporarily overcome, the gap 138 is reduced, and rotation stoppage extension 716 of upper cover 104 engages portion 610 to prevent further rotation of core 600, to thereby limit the amount of material 102 that is drawn out through gap 138. Upon the user releasing the force pressing covers 104 and 106 to each other, elements 718, 718 will again provide sufficient bias force to pivotally separate the covers relative to each other.

It is highly desirable that core 600 and the roll of material 102 wound thereon not rotate in a direction such as to inadvertently rewind the distal end of sheet material 102 back entirely into the containment space between covers 104 and 106. In other words, when a user presses together covers 104 and 106 after having drawn out a suitable length of material, and tears off the material, it is desirable that a small portion of the distal end of the remaining material 102 in container 100 remain visible and readily accessible to the user for further withdrawal of more sheet material. If core 600 and the roll of sheet material 102 wound thereon were to rotate in a winding-up rotational direction, and the distal end of sheet material 102 were thereby retracted entirely into the containment space, the user would have to disengage the detent means at opposite ends of the covers to reaccess the distal end of sheet material 102. To prevent such an occurrence, there is provided in lower cover 106 a flexible rotation-limiting cantilevered extension 720 preferably formed integrally with the first transverse inner wall 708 of lower cover 106.

As best understood with reference to FIGS. 7 and 8–11, the distal end of rotation-limiting element 720 cooperates with the toothed outer periphery of portion 612 in a pawl-and-ratchet arrangement made possible by suitable shaping of teeth 722 at the outer periphery of portion 612. This will be best understood with particular reference to FIGS. 8 and 10, wherein it is seen that when material 102 is pulled out by rotation of core 600 in a counter clockwise direction, there is a ramping contact between lead surfaces of gear teeth 722 and the distal end of rotation-limiting element 720. The user would hear soft clicks as he or she pulls out the sheet material 102 as a succession of teeth 722 ramp past the distal end of flexing rotation-limiting element 720. However, if there is any inclination of core 600 and the roll of sheet material 102 to rotate in the opposite direction, the trailing surfaces of gear teeth 722, being suitably angled as shown, will be stopped by head-on contact with the distal end of rotation-limiting element 720.

As is best seen in FIG. 7, a portion of lower cover 106 immediately inward of front edge 122 is formed like a shelf 724 over which material 102 may be drawn out. Furthermore, at the very forward portion of shelf 724, i.e., at front edge 122 of lower cover 106, there is provided a cutting edge 726 which preferably has a plurality of serrations to facilitate initiation of a tear of sheet material 102 pressed forcibly thereto. Even if the plastics material of which lower cover 106 is formed is generally resilient and elastic, i.e., to provide the desired spring effect to elements 718 and 720 as described above, it should be possible to select the material to have a sufficient hardness and toughness to allow integral formation of serrated cutting edge 726 as part of lower cover 106. In the alternative, a serrated metal strip may be provided. With such a structure, when the user has extracted a sufficient length of sheet material 102, he or she may readily press together upper and lower covers 104, 106 to each other to thereby obtain rotation stoppage by coaction of rotation stoppage element 716 and the teeth of portion 610, and may thereafter forcibly press the lower surface of sheet material 102 to the serrations of cutting edge 726 to obtain the desired cutting action. This would leave a small distal length of sheet material 102 lying on shelf 724 for subsequent ready access. This is best understood with reference to FIG. 1A.

Upon exhaustion of the sheet material 102 from a roll that has been in use for some time, the user must temporarily push in resilient detent extensions 130, 130 at the ends of lower cover 106 so that the hooked portion 132 of each disengages with the corresponding aperture 134 to enable a relatively large pivotal separation between upper and lower covers 104 and 106. The core 600 on which there is no more sheet material 102 left may then be removed and thrown away and a fresh roll on its own core put in place and the covers 104 and 106 again engaged by being pressed to each other. A user must be careful to ensure that a small length at the distal end of sheet material 102 on the new roll is accessible over shelf 724 at this time.

In the second embodiment, as best understood with reference to FIGS. 12–18, the core 600 has first and second ends 602, 604, and has tightly wound thereon a roll of sheet material 102, exactly as in the first embodiment as described above.

Similarly, as in the first embodiment, the dispenser body comprises upper cover 104 and lower cover 106 which are pivotally hinged to each other at their respective rear edges 116 and 124. The front edges 114, 122; extensions 718, 718 of the lower cover 106; and the detent mechanisms at opposite ends, comprising coacting elements 130, 132,134 and 136; are all preferably formed and operate as in the first embodiment. The following paragraphs will therefore focus on structural and functional aspects of the second embodiment which differ from those of the first embodiment.

Figures 12, 13:
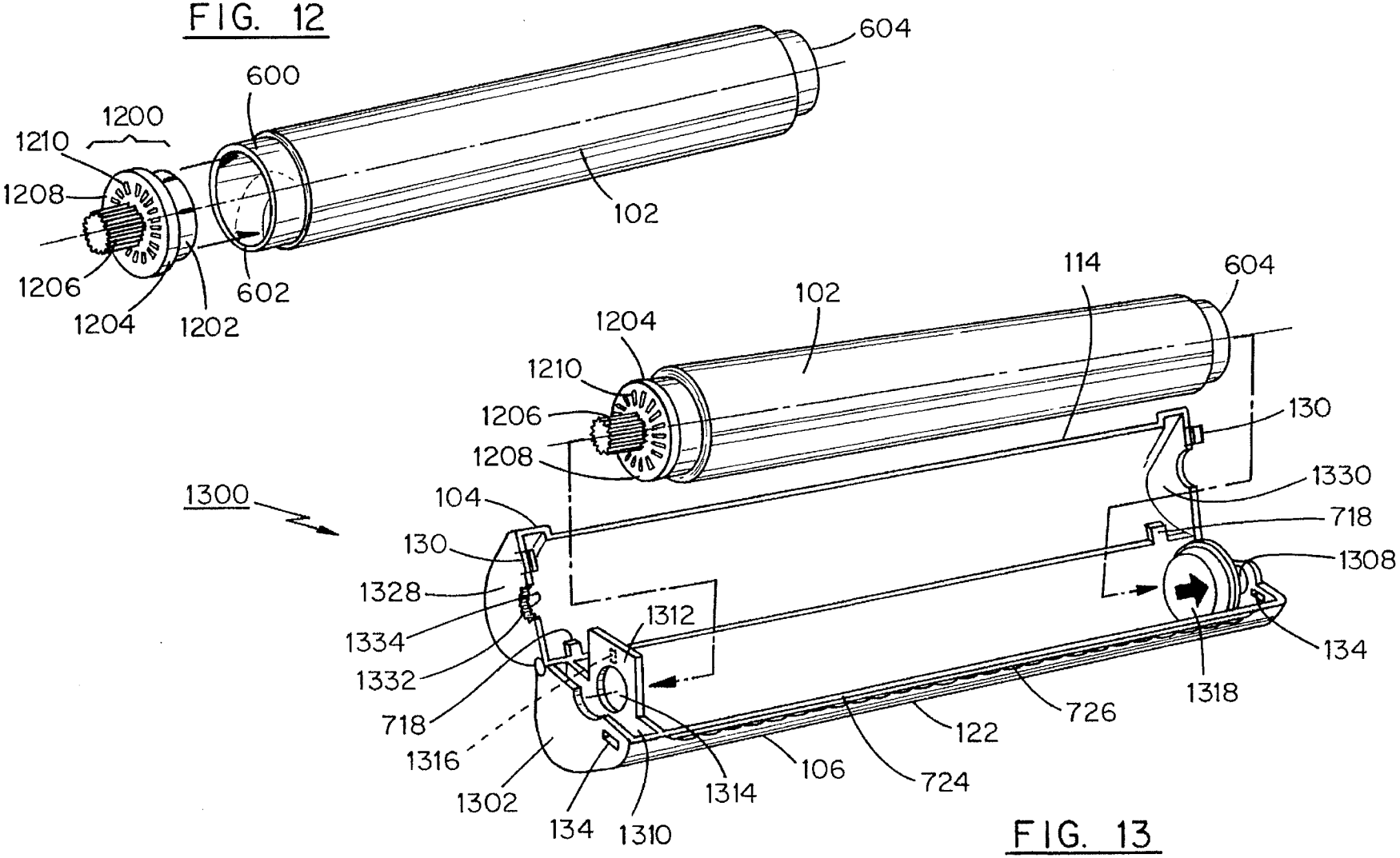
FIG. 12 is an exploded perspective view of the principal elements of a roll of sheet material according to the second embodiment of this invention.
FIG. 13 is an exploded perspective view of the dispenser body and a roll according to the second embodiment, with the upper and lower covers hinged apart to enable placement of the roll.

As best seen in FIG. 12, into the first end 602 of core 600 is inserted, for permanent affixation thereto preferably by adhesion, an axially symmetric first core end support element 1200 which comprises a first cylindrical portion 1202 having a first outer diameter sized to ensure a tight fit thereof into core 600; followed by a second coaxial cylindrical portion 1204 which has a second outer diameter larger than the first diameter of first portion 1202 and preferably somewhat larger than the diameter of the outer surface of core 600; followed by a third peripherally toothed coaxial cylindrical portion 1206 having a diameter smaller than the diameter of the second portion 1204. The second cylindrical portion 1204 has an annular circular face 1208, immediately adjacent the third cylindrical portion 1206, and a circular array of radially-oriented teeth 1210 is provided on annular surface 1208.

Figure 14:
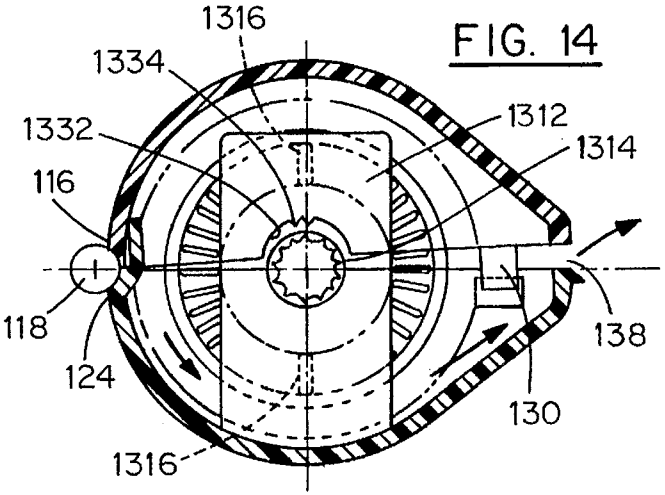
Figure 16:
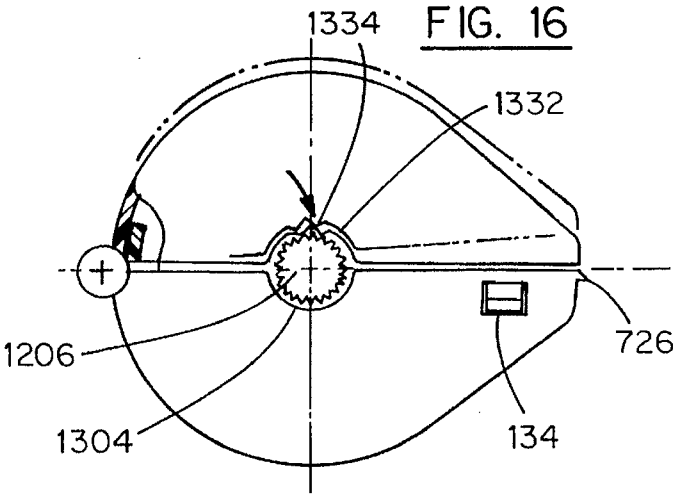

As best seen in FIGS. 13, 14 and 16, cover 106 has a first end wall 1302 which is provided with central cutout defined by a semicircular edge 1304 of a diameter slightly larger than the outer diameter of third cylindrical portion 1206 of first core end support means 1200 to non-bindingly support the same even when a user presses upper and lower covers 104, 106 to each other. Aperture 134, to serve as part of a detent means permitting limited pivotal separation between upper and lower covers 104 and 106, is provided in first end wall 1302 just as in the first embodiment described above.

Second end wall 1306 of lower cover 106 is provided with an inwardly extending cylindrical portion 1308 of a first internal diameter, which has a base containing a central aperture of a smaller second diameter. These diameters are not individually identified but the necessary relationship is clearly illustrated in FIGS. 15 and 17. The purpose of the cylindrical extension 1308 is to provide rotational support at the second end 604 of core 600 and the roll of sheet material 102 wound thereon, as more fully described below.

Adjacent to first end wall 1302, lower cover 106 is provided with a transverse inner wall 1310 which has a central outward extension 1312 in which is formed a circular aperture 1314 having a center on a line passing through the center of cylindrical extension 1308 and the middle point of the diameter of semicircular edge 1304. Aperture 1314 has a diameter slightly larger than the outer diameter of third cylindrical portion 1206 of first core end support 1200 and is intended to provide rotational support thereto. On an inside surface of upward extension 1312, i.e., on that surface which faces the second end wall 1306, are provided one or more protuberances 1316 which are shaped, sized and located to be in a position to press to the teeth 1210 of first core end support 1200 when the dispenser apparatus is in use with sheet material 102 contained therein. FIG. 13 shows one of these protuberances 1316, and FIG. 14 shows two of them.

At the second end of core 600 is applied a cup-like second core end support 1318, a portion of which is sized to fit closely into second end 604 of core 600. This element 1318 has a circular rim 1320 of a diameter preferably somewhat larger than the diameter of the outer surface of core 600, and a central outward cylindrical extension 1322 which is sized to non-bindingly fit into the aperture provided in the base of inward cylindrical extension 1308 of the second end wall 1306. This extension 1322 has a tapered enlarged end 1324 and preferably one or more axial slits (not shown), and element 1318 is preferably made of a firm but elastic plastics material. With such a structure, tapered end 1324 can be forcibly inserted into the aperture (not numbered) provided in the base of inward cylindrical extension 1308 of second end wall 1306 of the lower cover 106. The enlarged end 1324, once so located, essentially holds element 1318 loosely coupled to the inward cylindrical extension 1308 of the second end wall of lower cover 106.

A small compressive helical spring is provided between second core end support element 1318 and the base of cylindrical extension 1308 so as to bias them apart. It is retained in place, along with second core support element 1318, to inward cylindrical extension 1308. This is best understood with reference to FIG. 15, wherein the core 600 is shown biased to the left toward the first end walls of covers 104, 106.

In the structure described in the immediately preceding paragraphs, as will be understood by reference to FIG. 13, in the second embodiment the core 600 with first core end support means 1200 permanently affixed into first end 602 carries a tightly wound roll of sheet material 102 and may be dropped into lower cover 106 so that the third cylindrical portion 1206 of first core end support 1200 is first pushed through aperture 1314 of the transverse wall 1310. The second core end support element 1318 is pressed against the bias of spring 1326 sufficiently to allow second end 604 of core 600 to fit onto element 1318. The bias force of spring 1326 thereafter presses the core 600 and first core end support 1200, and especially the radially-oriented teeth 1210 thereof, against protuberances 1316 of transverse wall 1310. This is best understood with reference to the left-hand side of FIG. 15, where two short arrows pointing leftward are intended to indicate this bias and disposition. With this structure, as will be readily appreciated, protuberances 1316 and radially oriented teeth 1210 serve as a pawl-and-ratchet arrangement. Thus, when a user pulls on a distal end of sheet material 102 the pulling force exerted on the sheet material will be sufficient to overcome the ratcheting effect thus provided and will permit extraction of a selected length of sheet material 102. However, because of the bias force provided by spring 1326, and the ratcheting arrangement, inadvertent rewinding of core 600 and a roll-back of sheet material 102 thereon will be prevented.

As best seen in FIGS. 13 and 16, first end wall 1328 of upper cover 104 is formed with a cutout having an arcuate edge 1332 with one or more teeth 1334 which are shaped and sized to correspond to the teeth provided in the toothed outer periphery of third portion 1206 of first core end support element 1200. As in the first embodiment, extensions 718, 718 of lower cover 106 are shaped, sized and disposed to provide an elastic biasing force on an inside surface of upper cover 104 tending to pivotally move it away from lower cover 106. This separation is limited, as in the first embodiment, by providing a downward extension 130 to first end wall 1328 of upper cover 104, and a hook portion 132 with an angled surface 136, to cooperate with aperture 134 in lower cover 106. This ensures, as in the first embodiment, that upper and lower covers 104 and 106 normally are pivotally biased apart by a small amount corresponding to a frontal gap 138, as best understood with reference to FIGS. 14 and 16. With this arrangement, when a user presses covers 104 and 106 to each other, teeth 1334 of first end wall 1328 of upper cover 104 will positively engage with the corresponding teeth of toothed third portion 1206, as indicated by the broad arrow in FIG. 16. This will result in stoppage of further rotation of core 600 and roll of sheet material 102 and will permit the user to controllably limit the amount of sheet material 102 drawn out of the apparatus.

Figure 15:
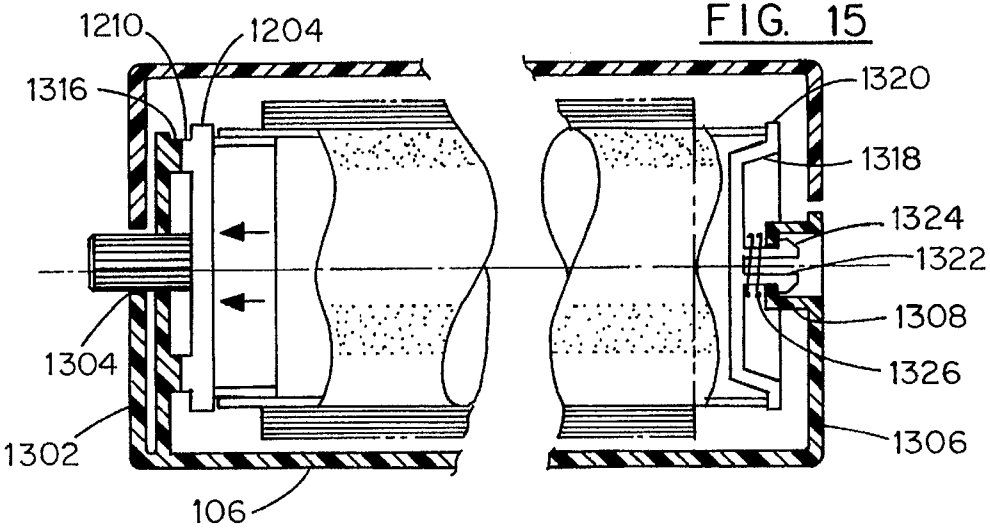
FIGS. 14 and 15 are transverse and longitudinal cross-sectional views, respectively, of the second embodiment, with the upper and lower covers biased apart.
Figure 17:
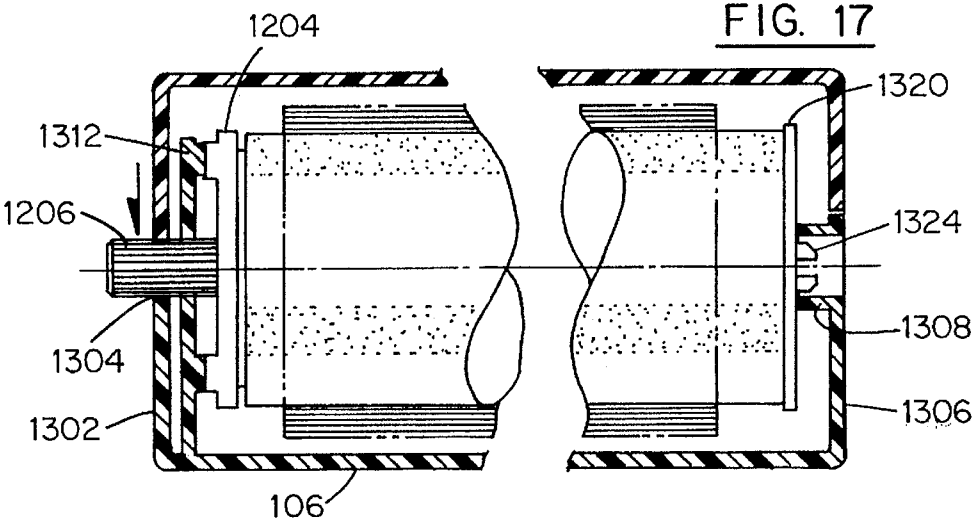
FIGS. 16 and 17 are transverse and longitudinal cross-sectional views, corresponding to FIGS. 14 and 15 respectively, with the upper and lower covers pressed to each other.
Figure 18:
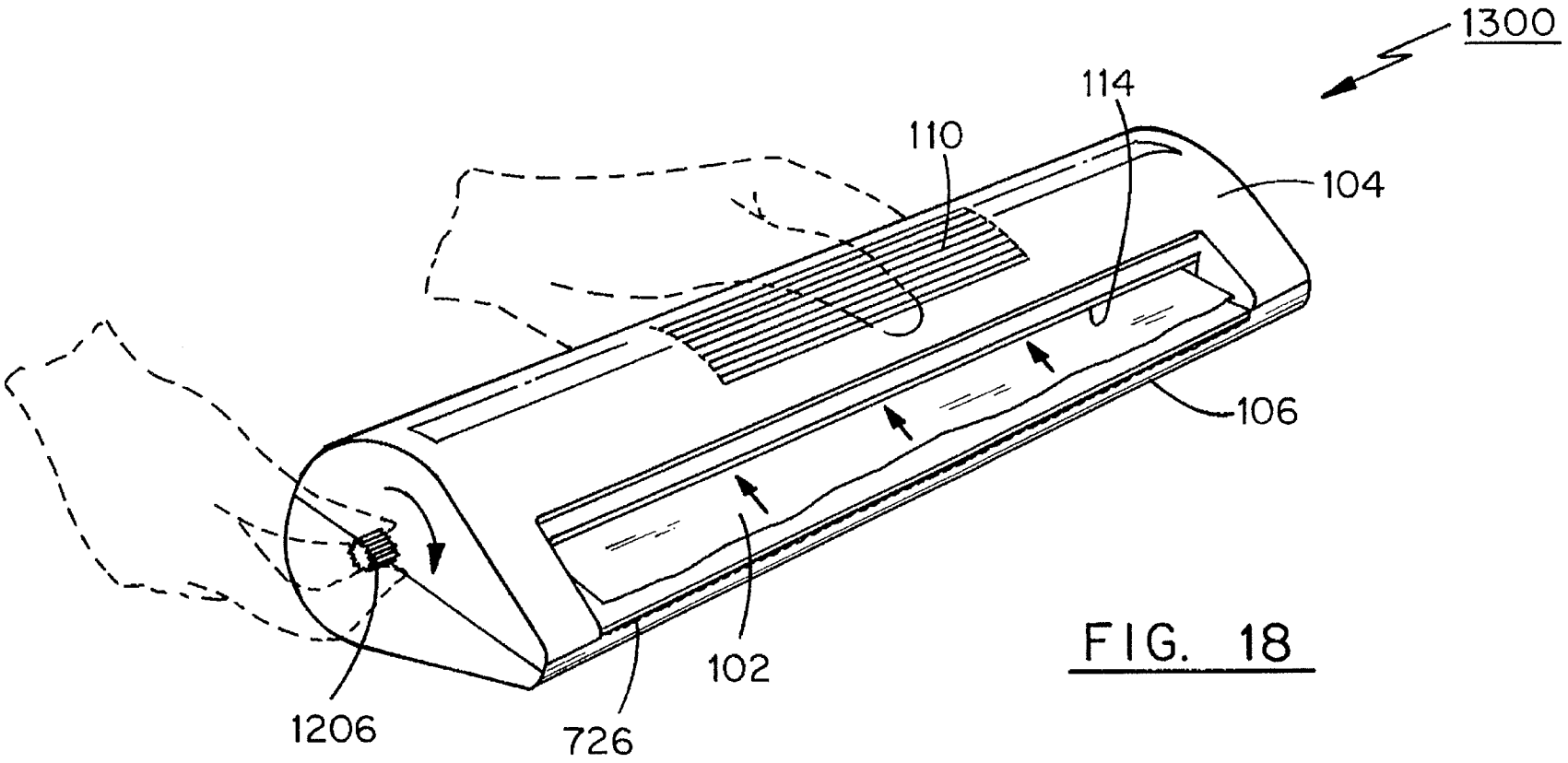
FIG. 18 is a perspective view of the dispenser body according to the second embodiment per FIG. 13, to illustrate how a distal end of the sheet material contained therein may be rewound by grasping and turning a portion of the corresponding roll body extending outwardly of an end of the dispenser body.
Figure 19:
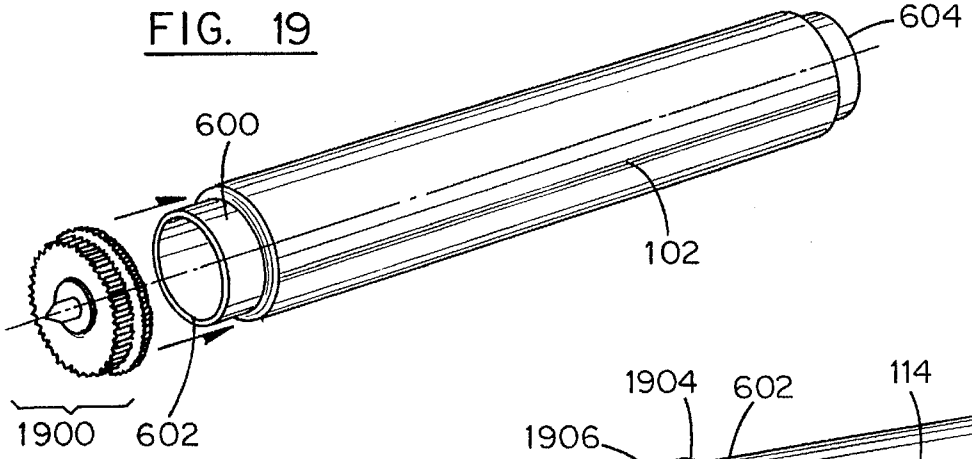
FIG. 19 is an exploded perspective view of the principal elements of a roll of sheet material according to the third embodiment of this invention.

Referring now to FIGS. 15, 17 and 18, it will be seen how the third cylindrical portion 1206 is made long enough to project axially and outwardly between the first end walls 1328 and 1302 of the upper and lower covers 104 and 106. In this arrangement, when a user holds the apparatus in one hand, but is not pressing upper and lower covers 104 and 106 to each other against the biasing force provided by extensions 718, 718, the exposed length of third cylindrical portion 1206 may be grasped to rotate the same in a direction which enables rewinding of any excess sheet material 102 which may have been drawn out earlier. This is indicated by the three short arrows in FIG. 18, and the rotation of third cylindrical portion 1206 is indicated by a curved short arrow.

As in the first embodiment, inwardly and adjacent to the lower front edge 122 of lower cover 106, is provided a shelf-like portion on which a short length of sheet material 102 may rest to be grasped by a user.

When the sheet material 102 is exhausted from a previously inserted roll, just as in the first embodiment, to disengage the detent arrangement comprised of elements 130, 132, 134 and 136 the user must press inwardly on hooked portions 132 through apertures 134 on both sides of the lower cover 106 to temporarily deform downward extensions 130. This will cause separation of the detent arrangement limiting the pivotal movement between upper and lower covers 104 and 106. Once the covers are thus separated, the apparatus may be opened, the second core end support 1318 pressed against the bias force of spring 1326, and the exhausted core 600 separated from the second core end support element 1318 and removed by pulling out the cylindrical portion 1206 from aperture 1314. A full replacement roll on its own core may then be inserted in a reversal of this procedure.

As with the first embodiment, the first core end support element 1200, the second core end support element 1318, and upper and lower covers 104 and 106, may all be made of a readily moldable plastics material in an attractive color and with a smooth finish. As in the first embodiment, to prevent slippage, one or both of the upper and lower covers 104 and 106 may be provided with a non-slip textured surface where the user would find it most convenient to grasp the apparatus.

In the third embodiment, as best understood with reference to FIGS. 19–24, core 600 and the roll of sheet material 102 wound thereon are similar to those discussed above in relation to the first and second embodiments.

The first core end support element 1900, however, has a cap-like form with a recessed central portion 1902 (best seen in sectional view in FIG. 22) which has a depth d preferably in the range ⅛–⅜ inches, and an internal diameter selected to closely fit to an outer surface portion of core 600 ending at first end 602 thereof. Affixation between first core end support 1900 and core 600 is obtained preferably by adhesion between the contacting surfaces of the outer end portion of core 602 and the rim-like annular portion which surrounds and covers the outer surface of core 600. On the outer periphery of this rim-like portion is formed a first peripherally toothed annular portion 1904 of a first diameter. Immediately adjacent thereto is formed a second peripherally toothed annular portion 1906 of a second and smaller diameter.

First core end support element 1900 also has a flat circular central portion 1908 on which is provided an outwardly extending central spindle 1910 having a tapered distal end 1912.

Core 600 has a length sufficient to allow for affixed insertion of its first end into first core end support 1900 and to also provide a short exposed length 12 immediately adjacent its second end 604 and extending beyond the roll of sheet material 102.

In the third embodiment the core and roll of material 102 wound thereon are to be rotatably supported to the lower cover 106 at spindle 1910 and an inside surface 606 of the core 600 immediately adjacent its second end 604.

As with the first and second embodiments, provision is made for limiting a direction of rotation of the core and roll and also for deliberate stoppage of such rotation to stop further unwinding of the sheet material 102 at the user's convenience. These objectives are realized by appropriate features provided to upper and lower covers 104 and 106 of the third embodiment 2000, as best understood with reference to FIGS. 20–24.

Upper cover 104 and lower cover 106 are pivotally connected to each other at their respective rear edges 116 and 124 by a hinge mechanism 108, as in the first and second embodiments. Likewise, lower cover 106 is provided with upward extensions 718, 718 formed, shaped, and disposed as in the first and second embodiments to exert a biasing force tending to pivotally separate covers 104 and 106 apart. Similarly, upper cover 104 is provided with one or two extensions 130 having hooked end portions 132 with slanting faces 136 to flexibly engage with corresponding apertures 134 formed in lower cover 106 and provide a detent engagement mechanism exactly as in the first and second embodiments.

Figure 22:
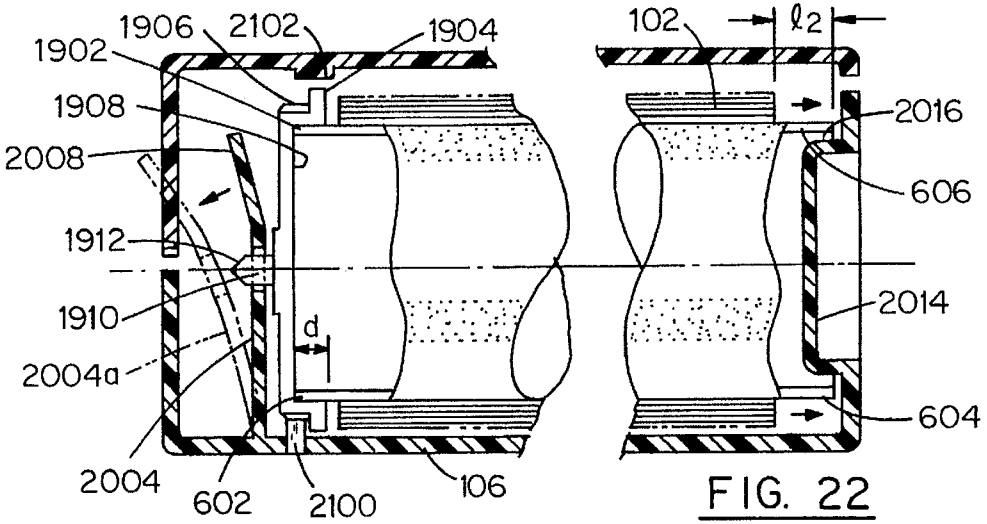
FIGS. 21 and 22 are transverse and longitudinal cross-sectional views, respectively, of the third embodiment with the upper and lower covers biased apart.
Figure 24:
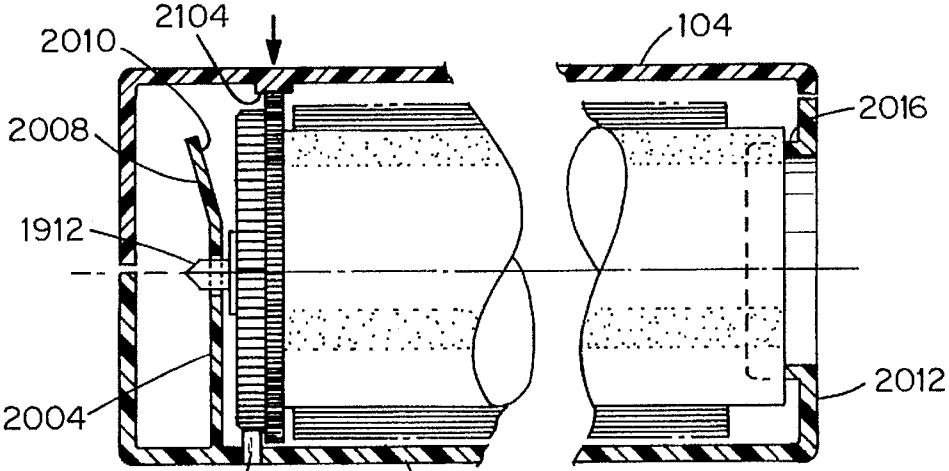
FIGS. 23 and 24 are transverse and longitudinal cross-sectional views, corresponding to FIGS. 21 and 22 respectively, with the upper and lower covers pressed to each other.
Figure 21:
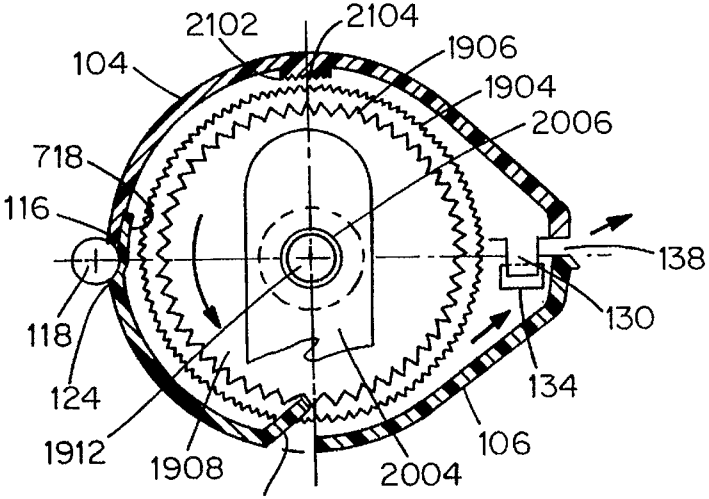
Figure 23:
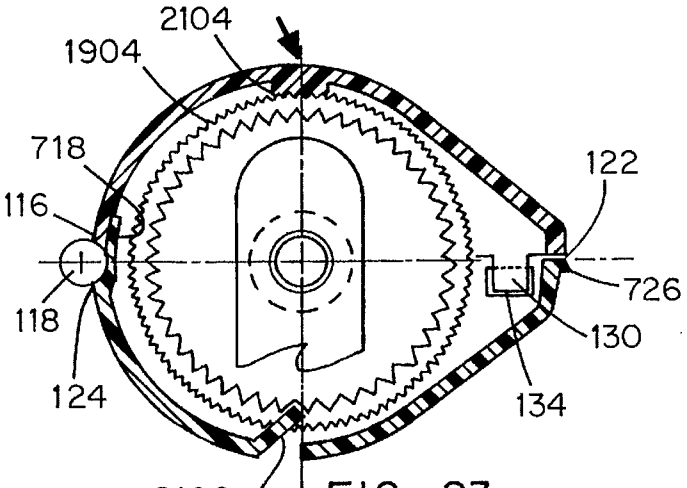

Inwardly of first end wall 2002 of lower cover 106 is provided a transverse inner wall 2003 which has an upward central extension 2004 provided with an aperture 2006 of a diameter slightly larger than the diameter of spindle 1910 of the first core end support element 1900. The distal end portion 2008 of upward extension 2004 is inclined toward the first end wall 2002 of lower cover 106. This is seen in FIGS. 22 and 24. Consequently, this inclined distal end portion 2008 has a correspondingly inclined surface 2010 facing the inside of the containment space.

The second end wall 2012 of lower cover 106 is formed somewhat larger than in the first and second embodiments, and has an inwardly extending cylindrical recessed portion 2014 having an annular cylindrical wall 2016 of a diameter slightly smaller than the inside diameter of core 600, as best understood with reference to FIG. 22.

Figure 20:
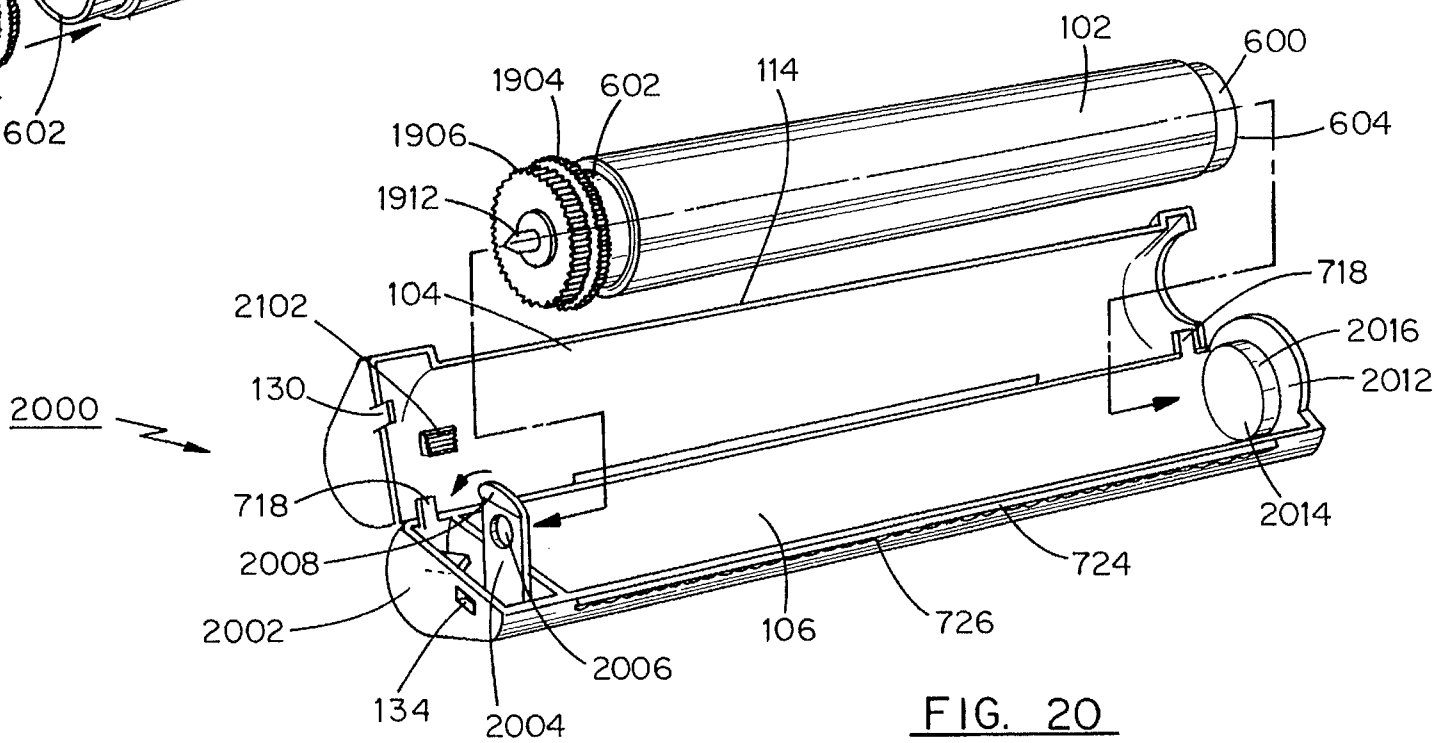
FIG. 20 is an exploded perspective view of the dispenser body and a roll according to the third embodiment, with the upper and lower covers hinged apart to enable placement of the roll.

As best understood with reference to FIG. 20, core 600 with first core end support element 1900 affixed thereto at its first end is lowered into lower cover 106 until second end 604 receives therein the recessed annular surface 2016 of second end wall 2004, which thereafter cooperates with inside end surface 606 of core 600 to support it rotatably. Forcible pressing of the tapered end surface 1912 of spindle 1910, as best understood with reference to FIG. 22, will cause flexible moving away of upward extension 2014 because of pressure put on surface 2010 of inclined distal end portion 2008 thereof. This is indicated by a short arrow pointed to the left in FIG. 22, wherein an elastically deflected position of upward extension 2004 is shown in chain line form and is identified as 2004a. This elastic deflection of upward extension 2004 continues until the tapered distal end of spindle 1912 enters aperture 2006 and is, thereafter, rotatably supported thereby. Upward extension 2004 then elastically returns to its upward position, as best seen in FIG. 24. Core 600 and roll of sheet material 102 tightly wound thereon are then together rotatably supported by coaction between spindle 1912 in aperture 2006 at the first end and by coaction between the inner end surface 606 of core 600 and the annular surface 2016 at the second end of lower cover 106, as best understood with reference to FIG. 22.

Lower cover 106 has a small inwardly lanced-in portion 2100, a distal end of which contacts the toothed outer periphery of portion 1906 of the first core end support element 1900, as best seen in FIGS. 21–24. Because of the inclination of lanced-in portion 2100 and the respective inclinations of the leading and trailing faces of the teeth on portion 1906, a pawl-and-ratchet arrangement is created which enables a rotation of the first core end support element 1900 (and the core 600 affixed thereto with its wound-on material 102) only in one direction, indicated by the curved arrow in FIG. 21. This permits withdrawal of the sheet material as generally indicated by the two short arrows to the right in FIG. 21. Thus, lanced-in portion 2100 of lower cover 106 and the peripheral teeth of portion 1906 of the first core end support element 1900 coact together to provide a simple but highly effective rotation-limiting means in the third embodiment.

At an inside surface of upper cover 104, preferably integrally formed therewith, is an inwardly depending portion 2102 provided with one or more teeth 2104 at the distal end surface. Teeth 2104 are formed to match in shape, size and disposition the teeth provided in the outer periphery of portion 1904 of first core end support element 1900. The dimension of inward extension 2102 of upper cover 104 is selected such that when the biasing force provided by extensions 718, 718 biases the covers 104, 106 apart there is no contact between teeth 2104 and the teeth on the outer periphery of cylindrical portion 1904. This is best understood by reference to FIGS. 21 and 22. However, when a user presses covers 104 and 106 toward each other, it is intended that teeth 2104 of inward extension 2102 of upper cover 104 should make contact with and engage to immediately adjacent teeth of cylindrical portion 1904 as best understood with reference to FIGS. 23 and 24. By this arrangement, as in the first and second embodiments, pressing together of covers 104 and 106 causes rotation stoppage and prohibits further drawing out of sheet material 102 until and unless the user releases external pressure and extensions 718, 718 pivotally bias apart covers 104 and 106.

Other features of the third embodiment, e.g., the shape, size, non-slip textured portions of the outer surface of covers 104, 106, etc., are substantially similar to those of the first and second embodiments, hence no detailed description thereof is believed necessary.

In the fourth embodiment, as best understood with reference to FIGS. 25–31, core 600 has first and second ends 602, 604 and a roll of sheet material 102 tightly wound on an outer surface between these ends. Similarly, as in the previously described embodiments, the dispenser body comprises upper cover 104 and lower cover 106 which are pivotally hinged at hinge 108 to each other at their respective rear edges 116 and 124. The front edges 114, 122 of covers 104, 106, respectively; extensions 718, 718 of lower cover 106; and the detent mechanisms at opposite ends, comprising coacting elements 130, 132, 134 and 136; are all preferably formed and operate as in the first through third embodiments. The following paragraphs will therefore focus on structural and functional aspects of the fourth embodiment which differ from those of the other embodiments.

Figure 25:
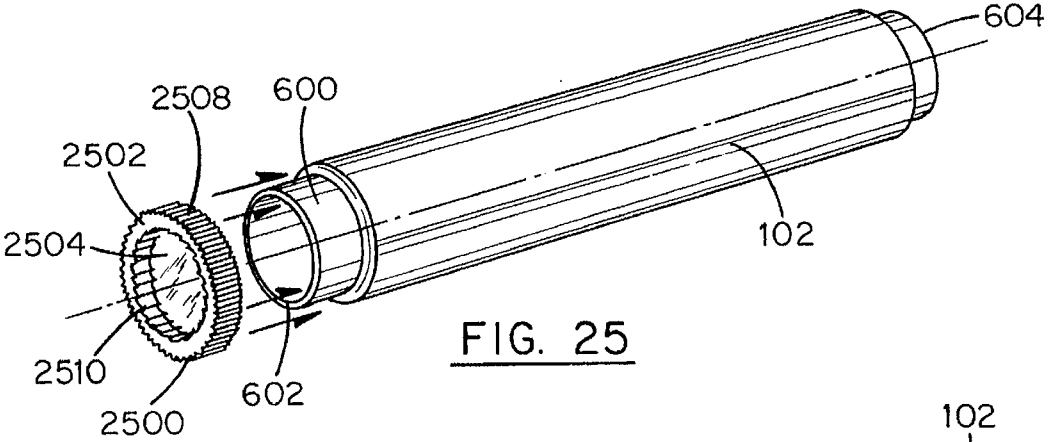
FIG. 25 is an exploded perspective view of the principal elements of a roll of sheet material according to the fourth embodiment of this invention.
Figure 29:
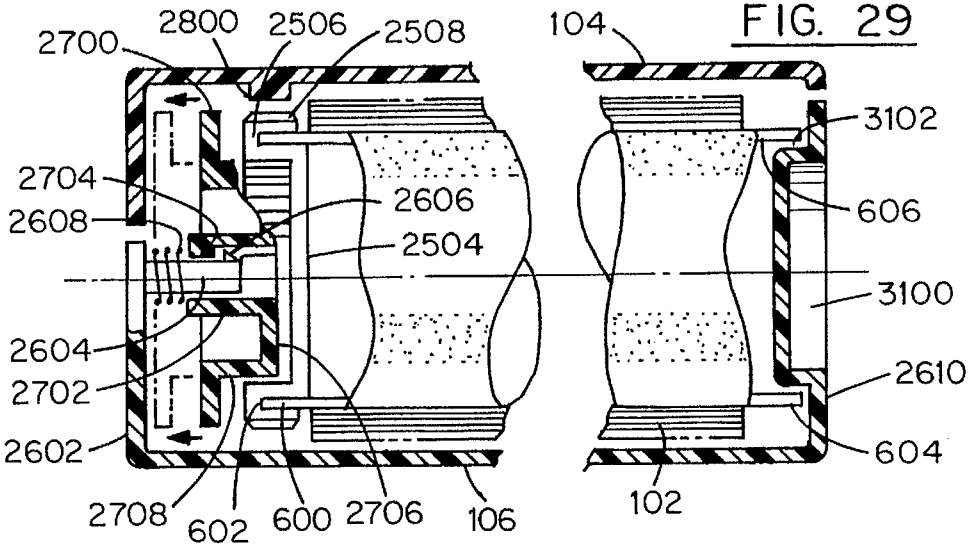
FIGS. 28 and 29 are transverse and longitudinal cross-sectional views, respectively, of the fourth embodiment, with the upper and lower covers biased apart.

As best seen in FIGS. 25 and 29, to the first end 602 of core 600 is fitted, for permanent affixation thereto preferably by adhesion, a first core end support element 2500 formed as a circular cap having an annular-grooved rim 2502. The inside of rim 2500 is formed as a flat circular base 2504 which is sized to closely fit into core 600. Rim 2502 is provided with a circular grooved-like recess 2506 shaped and sized to receive therein and tightly fit to end 602 and a short length of immediately adjacent portion of core 600, and an adhesive may be provided to cause affixation thereat between core 600 and first core end support element 2500.

Rim 2502 has an outer toothed periphery 2508 of a first diameter and an inner toothed periphery 2510 of a second and smaller diameter.

It will be appreciated from FIG. 29 that when first core end support element 2500 is thus fitted to the first end 602 of core 600, a sufficient length of the outer surface of core 600 must be provided to ensure accommodation of the wound-up sheet material 102 at the second end 604 of the core as in the third embodiment.

Figure 28:
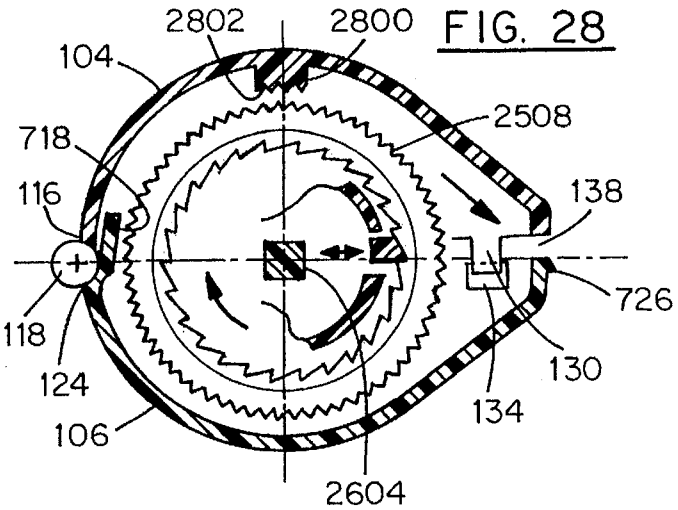

As best seen in FIGS. 28–31, upward extensions 718, 718 provided to lower cover 106 provide a continuous bias tending to pivotally separate upper and lower covers 104, 106 relative to each other within the bounds imposed by the detent elements, preferably provided at both ends of the dispenser body, which comprise elements 130, 132, 134 and 136 as in the previously described embodiments. To an inside surface of upper cover 104, as in the first embodiment, there is provided an inward, preferably integral, extension 2800 at the distal end of which is provided at least one tooth 2802 having a form matching that of the teeth on the outer periphery 2508. When covers 104 and 106 are biased apart to define a gap 138, as best seen in FIGS. 28 and 29, the one or more teeth 2802 remain entirely clear of the teeth of periphery 2508. However, when covers 104 and 106 are pressed to each other, as generally indicated by the short arrows in FIGS. 30 and 31, the one or more teeth 2802 are moved toward and engage with adjacent teeth of outer periphery 2508 of first core end support element 2500 to stop further rotation thereof. In this respect, therefore, a user of the fourth embodiment would obtain stoppage of rotation of the core end support element and sheet material 102 wound thereon as in the previous embodiments, i.e., by pressing together the covers 104 and 106 when a sufficient length of the sheet material has been withdrawn through gap 138.

Figure 26:
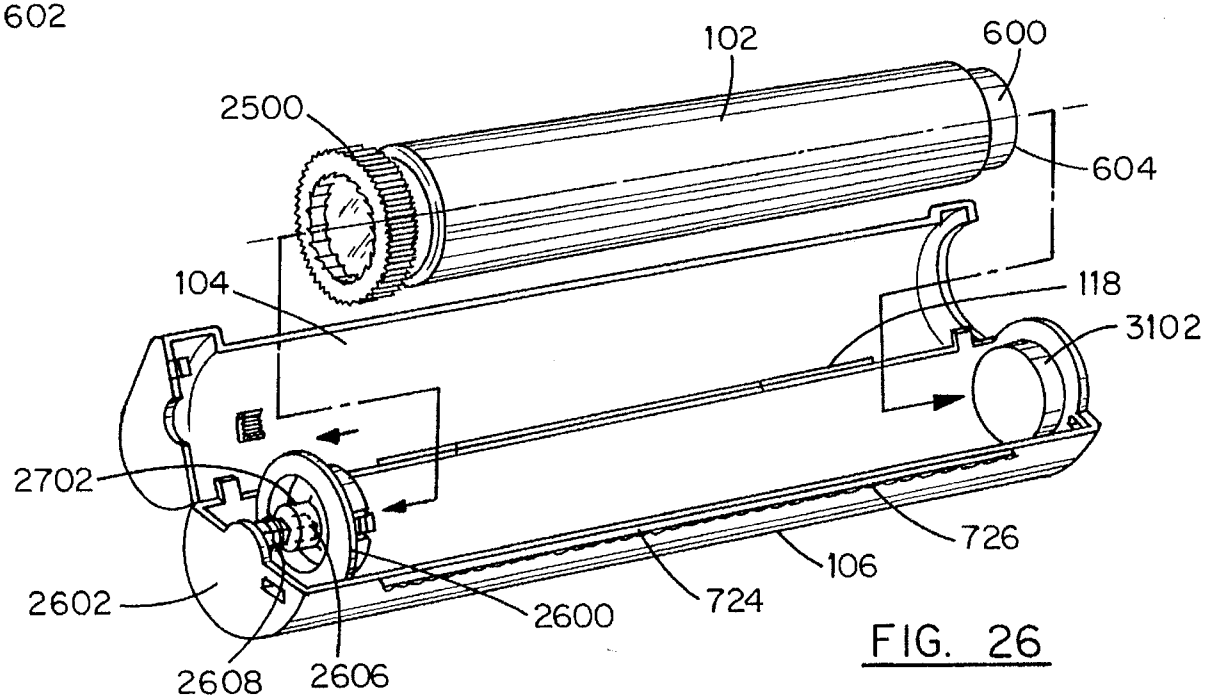
FIG. 26 is an exploded perspective view of the dispenser body and a roll according to the fourth embodiment, with the upper and lower covers hinged apart to enable placement of the roll.
Figure 30:
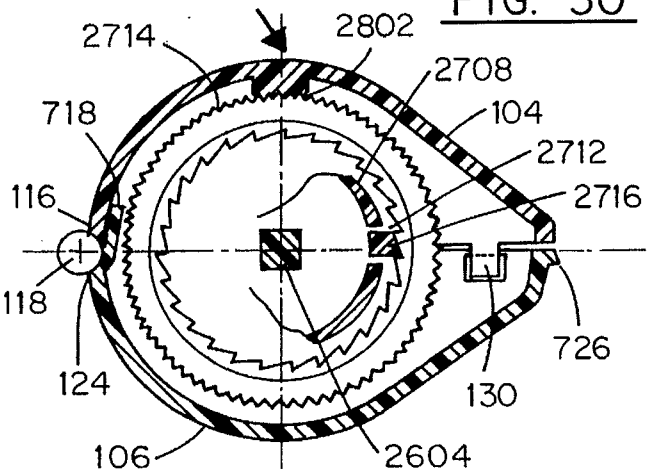

As best seen in FIGS. 26, 28, and 30, first end wall 2602 of lower cover 106 is provided with an inwardly extending portion 2604 which has a non-circular, preferably square, cross-section. Extension 2604 has a small radially-extending barb 2606 at its distal end. A compressive helical spring 2608 or a functional equivalent thereof is fitted around extension 2604 between an inner surface of first end wall 2602 and barb 2606.

Figure 27:
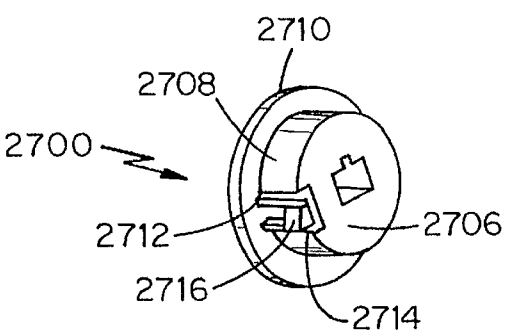
FIG. 27 is a perspective view of a slidable, spring-biased, core-end receiving element used in the fourth embodiment.

As best seen in FIG. 27, a circular retracting hub 2700 is provided, which has a central open cylindrical section 2702 with a square inside bore sized to slidably fit past barb 2606 onto inward extension 2604. As best seen in FIG. 29, there is a small radially inward lip 2704 at the distal end of cylindrical section 2702, to ensure that once hub 2700 is pressed onto inward extension 2604 subsequent coaction between inward lip 2704 and barb 2606 will prevent inadvertent sliding-off of retractable hub 2700 from inward extension 2604.

Figure 31:
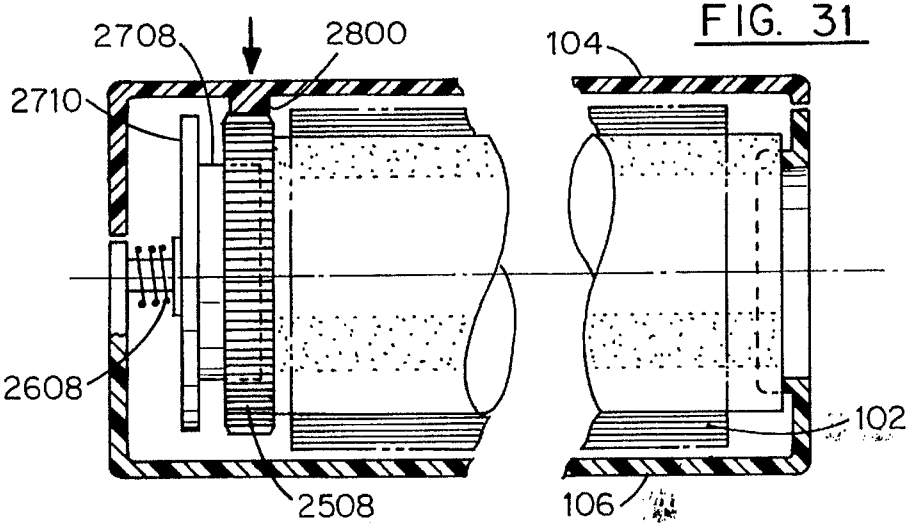
FIGS. 30 and 31 are transverse and longitudinal cross-sectional views, corresponding to FIGS. 28 and 29 respectively, with the upper and lower covers pressed to each other.

Retractable hub 2700 has a circular base 2706 ending in a cylindrical rim 2708 sized to slidably fit into the inner toothed periphery 2510 of first core end support element 2500, as best understood with reference to FIGS. 29 and 31. Rim 2708 ends in a distal flange 2710 having an outer diameter sized to be between the respective diameters of peripherally toothed portions 2508 and 2510 of first core end support element 2500. Rim 2708 is provided with a pair of cuts 2712 and 2714, defining therebetween a pawl section 2716 which extends sufficiently to contact the inner teeth of first core end support element 2500 in a pawl-and-ratchet arrangement. This is best understood with reference to FIGS. 28 and 30, wherein it will be seen that the inner teeth of the first core end support element 2500 are ramped so that the pawl-and-ratchet arrangement just described will permit rotation of first core end support element 2500 (and core 600 affixed thereto) in a direction which will allow withdrawal of sheet material 102 from the dispenser body but will prevent counter-rotation of the core. This will ensure against inadvertent rewinding of material 102 remaining on core 600 back into the containment space.

As will be readily understood from FIGS. 26 and 29, when a new core 600 with first core end support element 2500 affixed at the first end thereof is to be placed into lower cover 106, the user will contact first core end support element 2500 to an inside surface of flange 2710 and push against the bias force of compressive helical spring 2608 to fit the inside of first core end support element 2500 around rim 2708 and generate a sufficient longitudinal space to drop second end 604 of core 600 into position within lower cover 106. Then, due to the bias force of helical spring 2608, retractable flange 2700 will continue to push on first core end support element 2500 to ensure that an inside surface 606 immediately adjacent second end 604 of core 600 non-bindingly fits around an outer cylindrical surface 3102 of a cylindrical recess 3100 formed into second end wall 2610 of lower cover 106. This is best seen in FIG. 29. In effect, therefore, as in the third embodiment, the second core end support means is the inner surface 606 of core 600 immediately adjacent its second end 604. The second core support provided by the dispenser body is, therefore, the outer surface 3102 of recess 3100 on the lower cover 106.

To summarize the above, a user would obtain the roll of wound-up sheet material 102 wound onto the outer surface of the core 600 which has first core end support element 2500 affixed to the first end thereof. This fresh roll 102 is fitted into the lower cover 106 as described, and the user must then pivotally rotate the upper cover 104 to the lower cover 106 until the detent arrangements provided at both ends of the covers are about to engage. Before finally pressing the covers 104 and 106 to each other to engage the detents, the user should extract a short length at the distal end of sheet material 102 so that it extends between the front edges of the upper and lower covers via gap 138 therebetween.

Upper and lower covers 104, 106, retractable hub 2700, and first core end support element 2500 are all preferably made of a suitable, moldable, thermo-plastic material. The outer surfaces of upper and lower covers 104, 106 may be provided with non-slip surface portions as in the previously described embodiments. The pivotal connection between upper and lower covers 104, 106 may be obtained, as in the previously described embodiments, by any conventional hinging mechanism at 108.

It should be appreciated that even if there is a tendency of the wound-up material 102 to slide on the outer surface of core 600 when the core and wound-up material are placed into the dispenser body, as described earlier, a portion of first core end support element 2500 will prevent sliding-off of the wound-up material 102 from the outer surface of core 600 during insertion into the dispenser body. Subsequently, with appropriate sizing, the wound-up material 102 will remain in place for its intended use until enough of it has been withdrawn so as to require removal of exhausted core 600. The covers 104 and 106 can then be disengaged at the end detents therebetween and a replacement core and roll placed in.

In the fifth embodiment, as best understood with reference to FIGS. 32–45, in dispenser body 3300 upper and lower covers 104, 106 are pivotally connected at their respective rear edges 116, 124, at a hinge 108. They cooperatively define an elongate, generally cylindrical, containment space to rotatably support and contain roll of sheet material 102 wound on the outside of a cylindrical hollow elongate core 600. As in the first through fourth embodiments, covers 104 and 106 are latched to each other by detent mechanisms provided preferably at both ends. Covers 104, 106 are normally pivotally biased apart to a predetermined extent sufficient to define a small gap 138 at the front.

Figure 35:
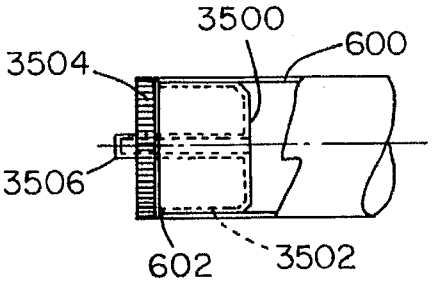
FIG. 35 is a partially-sectioned longitudinal view of one end core suitable for use with the fifth embodiment per FIGS. 32–34.
Figure 34:
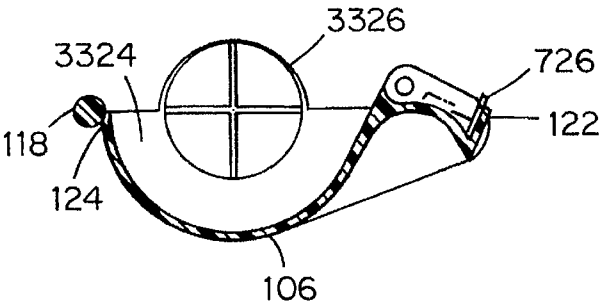
FIG. 34 is a transverse cross-sectional view of a portion of the lower cover of the fifth embodiment.

As best seen in FIG. 35, into a first end 602 of core 600 is inserted a first core end support element 3500 which has a first axially symmetric generally cylindrical portion 3502 having an outer diameter selected to ensure a close fit into core 600. Permanent affixation of element 3500 to core 600 is obtained by an adhesive. Immediately adjacent to the inserted first portion 3502 is a coaxial second cylindrical portion 3504 which has a diameter preferably equal to or slightly smaller than the outside diameter of the core 600. There is also provided a third coaxial portion in the form of a spindle 3506 which is to be rotatably supported to lower cover 106 as described below.

Rotational support is also to be provided at the second end 604 of core 600. In the fifth embodiment, as in the third and fourth embodiments, such rotational support is provided by a portion of the lower cover 106 non-bindingly received into end 604 of core 600 to make contact with an internal surface 606 immediately adjacent thereto. This is best understood with reference to FIGS. 33 and 36.

Figure 33:
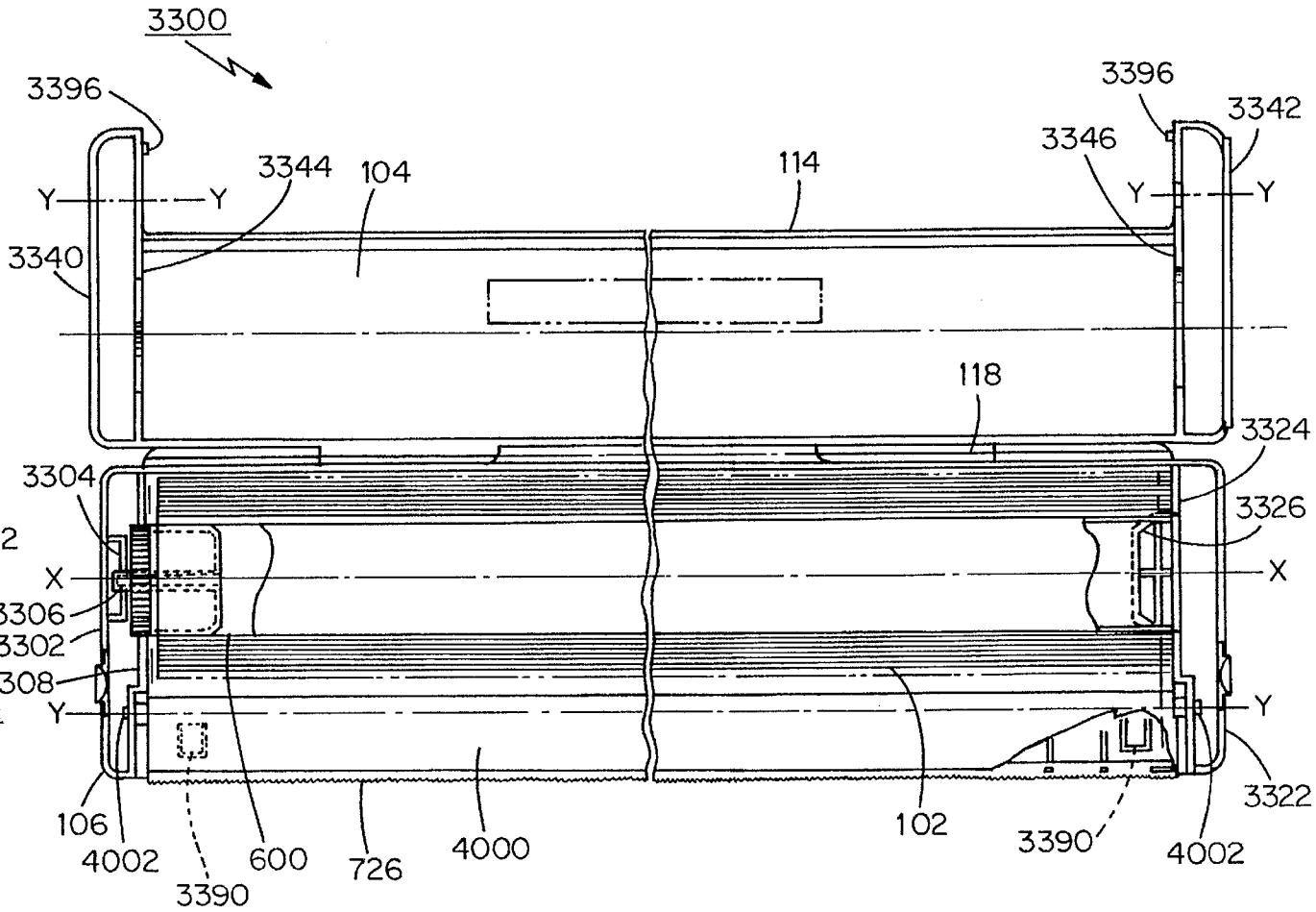
FIG. 33 is a partially-sectioned plan view of the dispenser according to the fifth embodiment according to FIG. 32, looking to the interior thereof.
Figure 32:
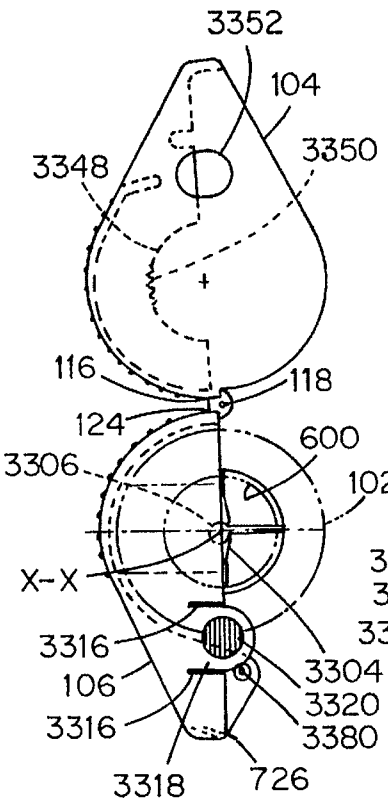
FIG. 32 is a partial cross-sectional view of the fifth embodiment of this invention, with the upper and lower covers shown pivoted almost totally apart about a connecting hinge.

As best seen in FIGS. 32 and 33, a first end wall 3302 of lower cover 106 is provided an internal support bracket 3304 in which is formed a cut-out 3306 having a circular edge of a diameter slightly larger than the outside diameter of spindle 3506 so as to receive the same in a non-binding manner.

Inside the containment space and spaced inwardly of first end wall 3302 is a first inner transverse wall 3308 which is provided with a cutout defined by a partially circular edge 3310. At a lower portion of wall 3308 is provided a cantilevered inclined extension 3312, a distal end 3314 of which is intended to make contact with the teeth of the outer periphery of second cylindrical portion 3504 of first core end support element 3500 when a full roll of material is placed into the containment space for use. This is best understood with reference to FIGS. 37 and 38. The teeth on the outer periphery of cylindrical portion 3504 are shaped so that in cooperation with the distal end 3314 of cantilevered element 3312 there is formed a pawl-and-ratchet arrangement to serve as a rotation-direction limiting means to prevent inadvertent roll-back of the sheet material into the containment space.

At a front portion of first end wall 3302 are provided two slits 3316, 3316 which thereby define a short cantilevered portion 3318 from which is provided a small, round, bulging portion 3320. As will be readily understood by persons of ordinary skill in the art, extension 3318 and the small bulging portion 3320 thereof are intended to perform the same functional purpose as downward extension 130 and the hooked portion 132 thereof in the first embodiment. Providing the bulging portion 3320 with an inclined or curved outer surface is intended to provide the same ramping function as was provided by inclined surface 136 in the detent mechanisms provided in the first through fourth embodiments.

Adjacent to and inwardly of second end wall 3322 of lower cover 106, as best understood with reference to FIG. 33, is provided a similar structure, i.e., upward extension 3318 defined between a pair of slits 3316, 3316, and a small bulging portion 3320 to provide part of a detent mechanism at the second end of the lower cover to match the one provided at the first end.

Inside the containment space and spaced inwardly of second end wall 3322 is a second inner transverse wall 3324 formed to have an inward generally cylindrical extension 3326 with a tapered end. Cylindrical extension 3326 has an outside diameter slightly smaller than the inside diameter of core 600 so as to non-bindingly and rotatably support the core during use, as best understood with reference to FIG. 33.

Figure 36:
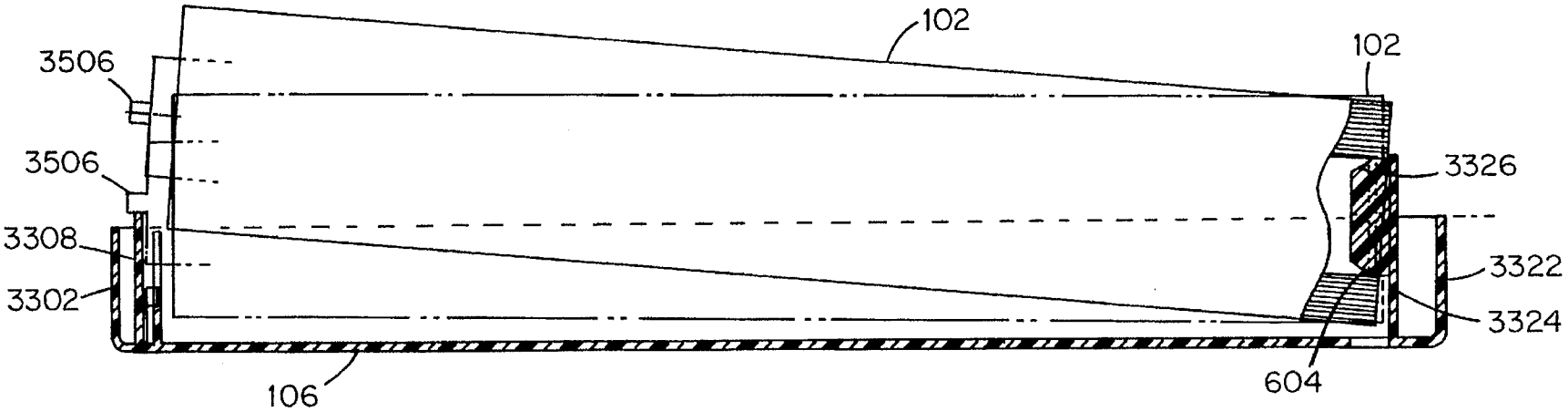
FIG. 36 is a partially-sectioned longitudinal view to illustrate a succession of stages in the placement of a roll on a core according to FIG. 35 in the bottom cover of the fifth embodiment.
Figure 37:
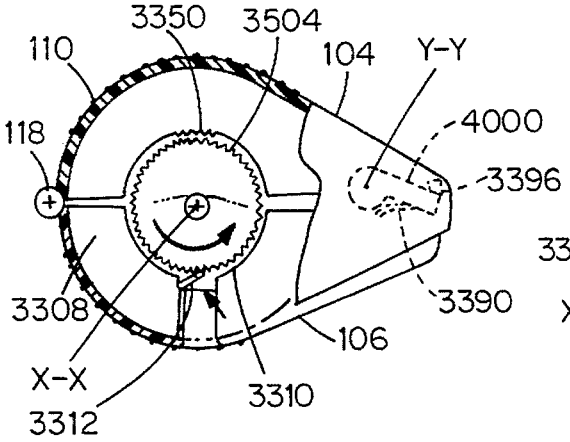
FIGS. 37 and 38 are partially-sectioned transverse views of the dispenser body according to the fifth embodiment, in a disposition thereof where the upper and lower covers are, respectively, biased apart or are pressed to each other.
Figure 38:
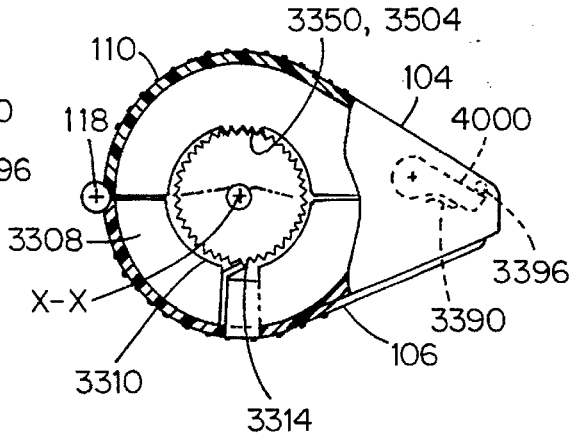

As will now be appreciated from reference to FIG. 36, when a new core with its full roll of sheet material 102 is to be placed to lower cover 106, the user must first slip second end 604 of core 600 over inward cylindrical extension 3326 of second transverse inner wall 3324 and, thereafter, lower spindle 3506 until it rests within curved cutout 3306 of the first inner transverse wall 3308. At this time, the user should pull out the distal end of sheet material 102 so that it lies over the front edge 122 of lower cover 106.

As best seen in FIG. 33, upper cover 104 has first and second end walls 3340 and 3342, respectively. Inwardly of these end walls are provided first and second inner transverse walls 3344 and 3346, respectively. First inner transverse wall 3344 is formed to have an arcuate cutout 3348 having at least one and preferably a plurality of inward teeth 3350 formed to match the teeth on the outer periphery of cylindrical portion 3504 of the first core end support element 3500.

First end wall 3340 is also formed to have an aperture 3352 sized, shaped and located to engage in a detent arrangement with the bulging portion 3320 of lower cover 106 in such a manner as to permit a limited pivotal separation of covers 104 and 106 relative to each other to define a front gap 138 therebetween. In similar manner, second end wall 3342 is also provided with a matching aperture (not shown) to cooperate with a corresponding disposed portion of lower cover 106 to provide a second detent mechanism for the same purpose.

Unlike the first through fourth embodiments, as described earlier, there are no upward extensions 718, 718 provided in lower cover 106 to press to and pivotally bias away upper cover 104 relative thereto. A different mechanism, as described below, accomplishes exactly the same purpose, i.e., to keep covers 104 and 106 pivotally separated apart by a small amount, as permitted by appropriate selection of the dimensions of apertures 3352 and the engaging bulging portions 3320 of the detent mechanisms. The purpose, as in the earlier-described embodiments, is to ensure that teeth 3350 are maintained totally clear of the gear teeth on the outer periphery of cylindrical portion 3504 while a user extracts a selected length of sheet material 102 via gap 138. Then, when the user has extracted a sufficient length of the sheet material, he or she may press together covers 104 and 106, overcoming a bias force to be provided as described below, until teeth 3350 of upper cover 106 press to and engage with the teeth of second cylindrical portion 3504 to stop further rotation of the core and wound-up sheet material 102 remaining thereon.

Figure 39:
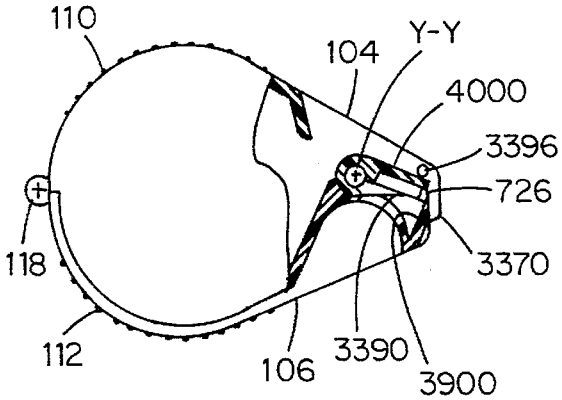
FIGS. 39 and 40 are views corresponding to the views of FIGS. 37 and 38, partially-sectioned adjacent the front edges of the upper and lower covers to explain the manner in which a cutting edge guard is disposed when the upper and lower covers are, respectively, biased apart or are pressed to each other.
Figure 40:
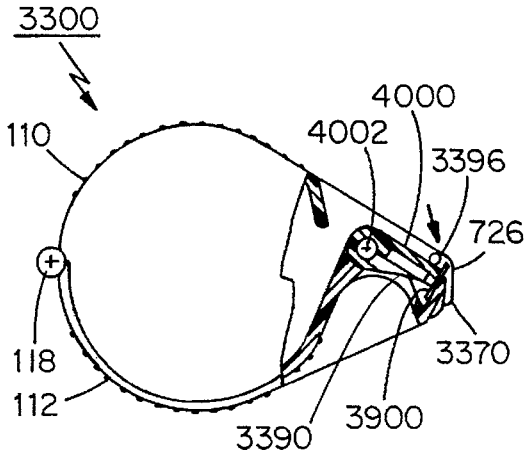

In the fifth embodiment, as best seen in FIGS. 39 and 40, there is provided an elongate cutting blade 3900 preferably provided with a serrated cutting edge 726. Cutting blade 3900 may be mounted in any convenient form, e.g., by a force-fit, adhesion, or the like, immediately adjacent to and along front edge 122 of lower cover 106.

In the fifth embodiment, unlike the first through fourth embodiments, there is also provided a blade guard 4000, best seen in cross-section in FIGS. 39 and 40, which is pivotally supported about an axis Y—Y, as best seen in FIG. 33. Blade guard 4000 has an elongate shape with a smooth, flat upper surface over which the sheet material 102 is to be drawn and on which a small distal end portion of the sheet material should normally rest to permit a user convenient access thereto. At opposite ends of blade guard 4000 are provided short spindles 4002, 4002, which fit into suitably sized and located small apertures 3380, 3380 provided in the first and second transverse inner walls 3308, 3324, respectively, of lower cover 106. By this means, cutter guard 4000 is free to rotatably pivot about axis Y—Y while being supported to lower cover 106.

Lower cover 106 is also provided with two inwardly lanced-in cantilevered extensions 3390, 3390, as best seen in FIGS. 33 and 37–40. These inwardly lanced-in extensions are formed and located to press against a lower surface of cutter guard 4000 so as to keep the forwardmost edge of the upper surface of cutter guard 4000 at a level above the serrated cutting edge 726 of cutter blade 3900. This is best seen in FIG. 39.

As also best seen in FIG. 39, upper cover 104 is formed to have two short inward extensions 3396, 3396, respectively, extending inwardly of corresponding inner surfaces of first and second transverse inner walls 3344 and 3346. As best seen with reference to FIG. 33, the location of these inward extensions 3396 relative to the position of axis Y—Y, when covers 104 and 106 are pivotally moved toward each other, is such as to cause the extensions 3396, 3396 to contact the outermost upper surface portions of cutter guard 4000. Therefore, as best seen with reference to FIGS. 39 and 40, when covers 104 and 106 are engaged by their cooperating detent mechanisms but are not being pressed to each other by a user, lanced-in elements 3390 exert an upward bias force tending to rotate cutter guard 4000 upward relative to the front edge 122 of lower cover 106. By contact between the upper surface of blade guard 4000 and the inward extensions 3396, 3396, this also lifts upper cover 104 to the extent permitted by the detent mechanisms formed of cooperating elements 3320 and 3352. This is illustrated in FIG. 39. In this disposition of the dispenser mechanism, the user may access the reachable distal end portion of sheet material 102 lying over the upper surface of cutter guard 4000 without risking direct and possibly hazardous contact with sharp cutting serrations at the edge 726 of cutter blade 3900. The user may then draw a selected length of sheet material 102 via gap 138, which requires rotation of core 600 as rotatably supported by lower cover 106.

Upon withdrawal of the selected length of sheet material 102, the user must press together covers 104 and 106, to thereby obtain engagement of teeth 3350 of upper cover 104 with the teeth at the outer periphery of cylindrical portion 3504 to stop further rotation of the core and roll of sheet material 102 still remaining thereon. Such a pressing together of upper cover 104 and 106, via inward extensions 3396, 3396, will force cutter guard 4000 against the bias force of lanced-in elements 3390, 3390 of lower cover 106 to permit contact between a lower surface of the sheet material 102 and the serrated upper edge of cutter blade 3900. This is best understood with reference to FIG. 40. The user may then force this contact between the lower surface of sheet material 102 and serrations 726 to obtain a tear 4500, as best seen with reference to FIG. 45 which is a front view of the dispenser body of the fifth embodiment when the covers are pressed to each other (as indicated by the short central arrows).

Note that because cutter blade 3900 is very close to the front edge 122 of lower cover 106, there will be a short length of material 102 that will thereafter remain on the upper surface of cutter guard 4000 subsequent access. As best seen in the plan view per FIG. 43, and because of the rotation-limiting action of the pawl-and-ratchet mechanism provided by cooperation between cantilevered element 3312 and the gear teeth on the outer periphery of portion 3504, even if the dispenser body is moved around, this distal end portion of sheet material 102 will remain loosely accessible over the top surface of cutter guard 4000.

Figure 41:
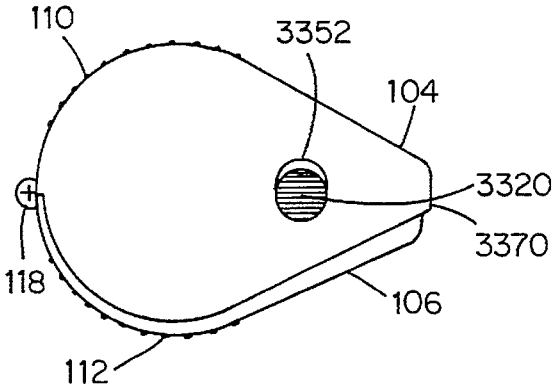
FIGS. 41 and 42 are end views of the dispenser according to the fifth embodiment, respectively in the biased apart and pressed together dispositions of the upper and lower covers.
Figure 42:
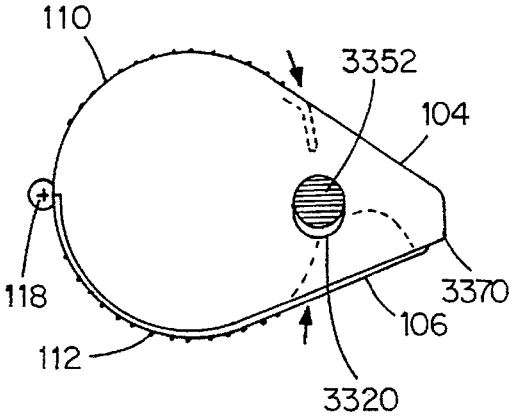
Figures 43, 44, 45:
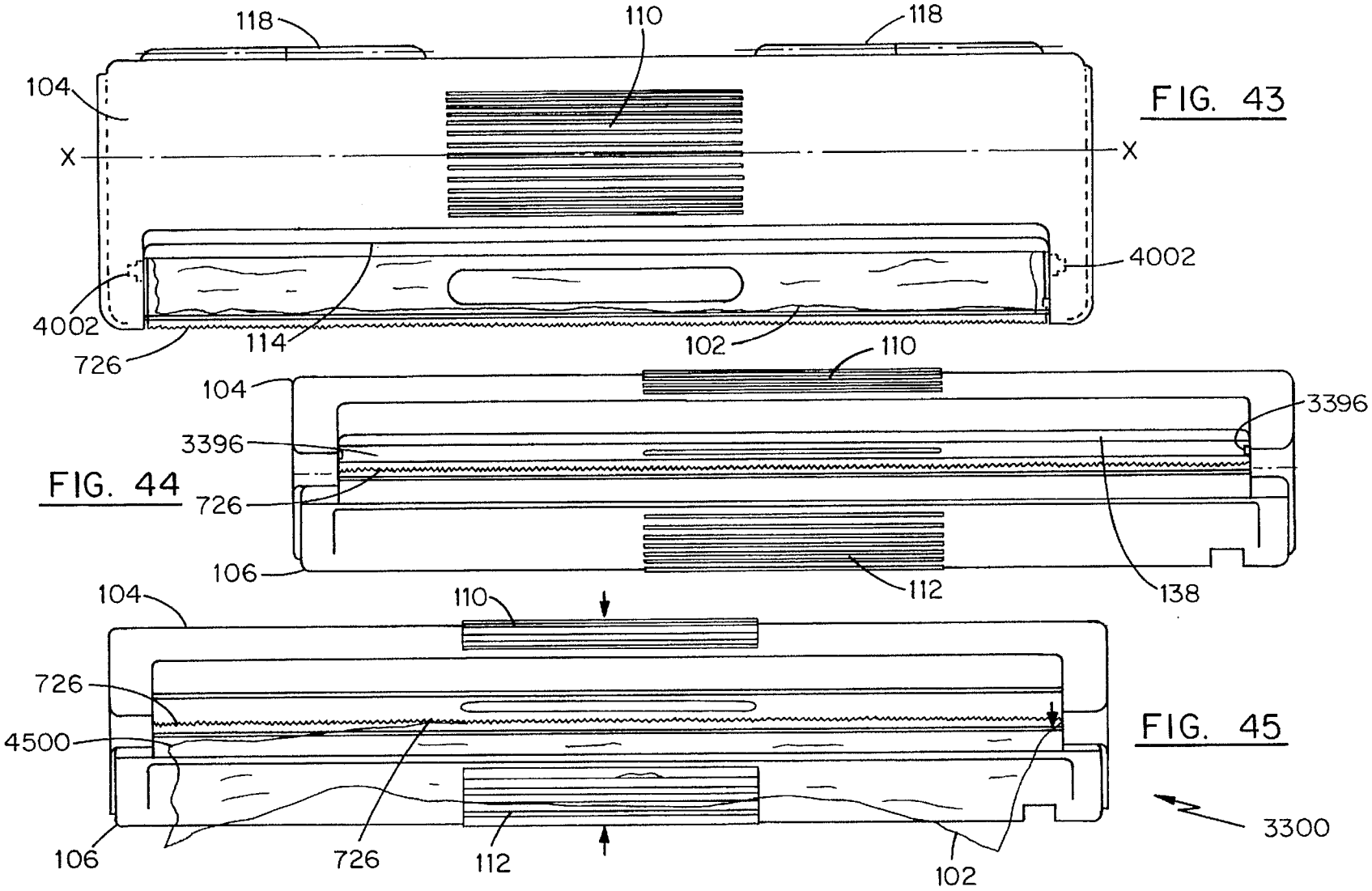
FIG. 43 is a plan view of dispenser according to the fifth embodiment, to show the positioning of the cutting edge guard in relation to the cutting edge.
FIGS. 44 and 45 are elongate front views of the dispenser according to the fifth embodiment, showing the upper and lower covers in their biased apart and pressed to dispositions, respectively.

As best seen in the frontal view per FIG. 44, when covers 104 and 206 are not pressed to each other, the user should be able to see forwardmost edge portion of cutter guard 4000 slightly above the serrations 726 of cutter blade 3900. However, as best seen in FIG. 45, once a selected length of sheet material 102 has been withdrawn and the user has pressed cover 104 to cover 106, the previously visible edge portion of cutter guard 4000 is depressed and the drawn sheet material 102 can be forcibly contacted to the serrated edge 726 of cutter blade 3900 to initiate tear 4500 to cut off the selected length of sheet material. Forward corner portions 3370, 3370 of upper cover 104 preferably overlap corresponding corner portions of lower cover 106, as best seen in FIGS. 41 and 42 and, because they bracket cutting blade 3900, provide additional protection to the user against harm by inadvertent contact with sharp corners of the blade.

As in the first through fourth embodiments, upper and lower covers 104, 106 and first core end support element 3500 may all be made of an attractively colored, molded, resilient plastics material. Non-slip surface portions 110, 112 may either be directly molded in or provided in any other convenient manner, as best seen in FIGS. 43–45. Selected plastics material, and the transverse and thickness dimensions of the integral biasing elements 3390, etc. can be readily determined by persons of ordinary skill in the mechanical arts.

It should be appreciated that in the cores according to each of the five embodiments described above, the provision of the first core end support element determines how and where the corresponding first end of core 600 will be disposed during use of the dispenser apparatus. Therefore, if the winding of sheet material 102 on core 600 is selected appropriately, there can be only one way in which each core and roll can be placed between the upper and lower covers 104 and 106. This should simplify matters significantly for users.

Typically, a user would obtain an individual roll of wound-up sheet material 102 on its own core 600 with a first core end support element of a type to match a particular dispenser body comprised of corresponding upper and lower covers 104 and 106. The core can be placed within the dispenser body in only one way, and the sheet material can be drawn out of the dispenser body by a rotation of the core in only one selected direction. The core rotation-direction limiting means will ensure that there will be no inadvertent roll-back of the sheet material within the containment space.

All five embodiments operate in virtually the same way from a user's point of view: a new roll of sheet material is placed into the lower cover, the upper and lower covers are moved to engage each other by their detent mechanisms, selected lengths of sheet material are withdrawn and torn off by pressing to the front tearing serrations, and the rolled-up material cannot inadvertently roll back.

Persons of ordinary skill in the mechanical arts will readily appreciate that with obvious minor modifications it should be possible to provide lower covers of the first through fourth embodiments with blade guards very similar to the blade guard 4000 described in detail with respect to the fifth embodiment. Minor modifications to lower cover 106, to provide resilient, upwardly biasing lanced-out portions comparable to 3390 (best seen in FIG. 33) can be readily provided in an obvious modification to the lower covers of the other embodiments. This would ensure that the front edge of the guard covers so placed would normally be raised sufficiently above the tearing serrations of the cutting edge as to protect a user from accidental abrasions.

Although the present invention has been described and illustrated in detail, it should be clearly understood that the same is by way of illustration and example only and is not to be taken by way of limitation, the spirit and scope of the present invention being limited only by the terms of the appended claims.

What is claimed is:

1. Apparatus for containing a replaceable roll of a sheet material and for enabling controlled removal of selected lengths of the sheet material wound on a hollow core having first and second ends and first and second core end support means provided respectively thereat, comprising:

an upper cover pivotally connected to a lower cover, the upper and lower covers each comprising an elongate wall having respective front and rear edges and transverse first and second end walls, the upper and lower covers each being shaped and sized to cooperatively define a containment space for containing the roll and core therebetween, a free end of the sheet material unwound from the roll being accessible through an elongate material delivery gap of adjustable width between the front edges of the upper and lower covers;

first support means located inside the containment space adjacent to the first end walls of the upper and lower covers for rotatably supporting a first end of the core by cooperating with the first core end support means;

second support means located inside the containment space and adjacent to the second end walls of the upper and lower covers for rotatably supporting a second end of the core by cooperating with the second core end support means;

biasing means for resiliently biasing the upper and lower covers to pivotally separate them apart;

separation limiting means for limiting an extent of a pivotal separation generated between the upper and lower covers by the biasing means; and rotation stopping means for stopping rotation of the core to limit an amount of the material unrolled from the roll via the material delivery gap.

2. The apparatus according to claim 1, wherein:

the biasing means comprises a spring element mounted to one of the upper and lower covers and disposed so as to exert a biasing force on the other of said first and second covers so as to cause a pivotal separation between the first and second covers.

3. The apparatus according to claim 1, wherein:

the separation limiting means comprises a detent element mounted to one of the upper and lower covers, and a detent element engagement element provided at the other of the upper and lower covers so as to engage with the detent element when the upper and lower covers are pivoted toward each other against a biasing force provided by the biasing means, the engagement being maintained so as to permit a predetermined pivotal separation between the upper and lower covers to thereby limit an opening of the material delivery gap.

4. The apparatus according to claim 1, further comprising:

core rotation-direction limiting means, cooperating with the first core end to limit a rotation of the core to a rotation in a selected direction around a core axis.

5. The apparatus according to claim 1, further comprising:

tear means disposed adjacent said front edge of said lower cover for initiating a tear in said sheet material when said sheet material is forcibly contacted thereto.

6. The apparatus according to claim 5, wherein:

said rotation stopping means comprises an extended element provided at said upper cover so as to totally clear said core when the material delivery gap is held open by said biasing means pivotally separating said upper and lower covers and which engages with said core to stop rotation thereof when the upper and lower covers are pivotally pressed to each other.

7. The apparatus according to claim 6, further comprising:

means for preventing operational contact between the tear means and the sheet material until the upper and lower covers are pressed to each other.

8. The apparatus according to claim 7, wherein:

the tear means comprises a longitudinal element with a serrated tearing edge, mounted along the front edge of the lower cover; and the means for preventing operational contact comprises a substantially flat elongate guard element pivotally mounted to a front portion of the lower cover, with a resilient element disposed to bias a front edge portion of an upper surface of the guard element to a position above the serrated tearing edge, wherein the upper cover is formed to contact the upper surface of the guard element so as to press the front edge portion of the upper surface thereof below the serrated tearing edge when the upper and lower covers are pivotally pressed to each other sufficiently to overcome the bias of the resilient element, whereby an operational contact between the sheet material and the serrated tearing edge is enabled.

9. The apparatus according to claim 8, wherein:

the guard element is made of a plastic material and is hinged at opposite ends to the lower cover; and the resilient element is formed integrally with the lower cover.

10. The apparatus according to claim 9, wherein:

said first and second covers are formed of a molded plastic material and are pivotally connected to each other by a hinge mechanism;

the biasing means comprises a length of material integral with the lower cover and is shaped and disposed so as to resiliently press against an inner surface of the upper cover to exert a bias force constantly acting to pivotally separate the upper and lower covers apart; and the separation limiting means comprises a detent element integral with one of the upper and lower covers, and a detent element engagement element integral with the other of the upper and lower covers and disposed so as to engage with the detent element when the upper and lower covers are pivoted toward each other against a biasing force provided by the biasing means, the engagement being maintained so as to permit a predetermined pivotal separation between the upper and lower covers to thereby limit an opening of the material delivery gap.

11. The apparatus according to claim 10, further comprising:

core rotation-direction limiting means, cooperating with the first core end to limit a rotation of the core to a rotation in selected direction around a core axis; and wherein said detent element is formed integrally with one of the upper and lower covers and the detent element engagement element is formed integrally with the other of said upper and lower covers, said core rotation-direction limiting means comprises an element formed integrally with said lower cover, and said extended element of said rotation stopping means is formed integrally with said upper cover.

12. The apparatus according to claim 11, wherein:

said upper and lower covers are formed of a molded plastic material and are pivotally connected to each other by a hinge mechanism.

13. The apparatus according to claim 1, wherein:

said upper and lower covers are formed of a molded plastic material and are pivotally connected to each other by a hinge mechanism.

14. The apparatus according to claim 1, wherein:

the biasing means comprises a length of material integral with the lower cover and shaped and disposed so as to resiliently press against an inner surface of the upper cover to exert a bias force constantly acting to pivotally separate the upper and lower covers apart.

15. The apparatus according to claim 1, wherein:

the containment space defined by the upper and lower covers is substantially cylindrical in shape, the lower cover has an elongate shelf portion extending outwardly of said substantially cylindrical containment space to the front edge of the lower cover, and the front edge of the upper cover extends over the elongate shelf portion and is disposed to be located inwardly of the front edge of the lower cover, whereby a distal end portion of the sheet material extends over the shelf portion between the respective front edges of the upper and lower covers and is thereby positioned to be readily accessible by a user.

16. The apparatus according to claim 1, wherein:

said upper and lower covers are formed of a molded plastic material and are pivotally connected to each other by a hinge mechanism;

the biasing means comprises a length of material integral with the lower cover and is shaped and disposed so as to resiliently press against an inner surface of the upper cover to exert a bias force constantly acting to pivotally separate the upper and lower covers apart; and the separation limiting means comprises a detent element integral with one of the upper and lower covers, and a detent element engagement element integral with the other of the upper and lower covers and disposed so as to engage with the detent element when the upper and lower covers are pivoted toward each other against a biasing force provided by the biasing means, the engagement being maintained so as to permit a predetermined pivotal separation between the upper and lower covers to thereby limit an opening of the material delivery gap.

17. The apparatus according to claim 16, wherein:

the containment space defined by the upper and lower covers is substantially cylindrical in shape, the lower cover has an elongate shelf portion extending outwardly of said substantially cylindrical containment space to the front edge of the lower cover, and the front edge of the upper cover extends above the elongate shelf portion and is disposed to be located inwardly of the front edge of the lower cover, whereby a distal end portion of the sheet material extends over the shelf portion between the respective front edges of the upper and lower covers and is thereby positioned to be readily accessible by a user.

18. The apparatus according to claim 17, further comprising:

core rotation-direction limiting means, cooperating with the first core end to limit a rotation of the core to rotation in a selected direction about a core axis; and tear means disposed adjacent said front edge of said lower cover for initiating a tear in said sheet material when said sheet material is forcibly contacted thereto.

19. The apparatus according to claim 18, wherein:

said detent element is formed integrally with one of the upper and lower covers and the detent element engagement element is formed integrally with the other of said upper and lower covers;

said core rotation-direction limiting means comprises an element formed integrally with said lower cover; and said extended element of said rotation stopping means is formed integrally with said upper cover.

20. An elongate core having first and second ends and a generally cylindrical outer surface therebetween on which a length of sheet material is wound to form a roll, the core being formed to be removably disposable in a rotatably supported position within a containment space defined between pivotally connected upper and lower covers of an elongate hand-held dispenser body which comprises a first support means inside the containment space adjacent to respective front end walls of the upper and lower covers for supporting the first end of the core and second support means also inside the containment space and located adjacent to respective second end walls of the upper and lower covers for supporting the second end of the core, biasing means for resiliently biasing the upper and lower covers pivotally apart to define a gap through which a length of the sheet material is unwound from the roll, means for controlling a direction of rotation of the core and roll and means for stopping rotation of the core end roll to limit the length of material being unwound from the roll, the core comprising:

a first core end support means located at the first end of the core for cooperating with the first support means to thereby rotatably support the core; and a second core end support means located at the second end of the core for cooperating with the second support means to thereby rotatably support the core, wherein the first core end support means also coacts with the means for controlling the direction of rotation of the core end roll to ensure against inadvertent rewinding of the unwound material, and wherein the first core end support means is formed of a plastic material and is affixed to the core by adherence thereto with an adhesive material.

21. The core according to claim 20, wherein:

the sheet material comprises a plastic material.

22. The core according to claim 20 wherein:

the sheet material comprises a metal film.

23. The core according claim 20, wherein:

the first core end support means comprises a first multi-sectioned element having an elongate central axis, a first cylindrical section formed symmetric about said axis and having a first outer diameter sized to be closely fitted within the first end of the core to be permanently affixed thereat, a coaxial second cylindrical section with a toothed outer periphery having a second outer diameter, and a coaxial third cylindrical section with a toothed outer periphery having a third outer diameter, wherein said second diameter is larger than said first and third diameters, wherein the second core end support means comprises an end portion of the outer surface of the core adjacent the second end thereof, wherein the first support means provides support to the first core end support means at said coaxial third cylindrical section, and the second support means provides support to the second core end support means by contacting the outer surface at said second end of the core, and the means for controlling the direction of rotation of the core and roll cooperates with the toothed outer periphery of the coaxial third cylindrical section in a pawl and ratchet arrangement to limit the direction of rotation of the core and roll to enable unwinding of the sheet material from the roll while preventing inadvertent rewinding of the sheet material back onto the roll.

24. The core according to claim 23, wherein:

the core and the first core end support means are shaped and sized so as to fit totally within the containment space defined by the upper and lower covers, and the sheet material as wound on the roll presents a width smaller than a corresponding length of the gap through which the sheet material is unwound from the roll.

25. The core according to claim 23, wherein:

the toothed outer periphery of the second cylindrical section of the first core end support means is shaped, sized, and located so as to be totally clear of the means for stopping rotation of the core and roll when the gap between the upper and lower covers is held open under the action of the biasing means and so as to engage with the means for stopping rotation of the core and roll when the upper and lower covers are pivoted toward each other by a user in opposition to the biasing means.

26. The core according to claim 25, wherein:

the first core end support means is made of a plastic material and is adhered to the core for said permanent affixation thereto; and the core and the first core end support means are shaped and sized so as to fit totally within the containment space defined by the upper and lower covers, and the sheet material as wound on the roll presents a width smaller than a corresponding length of the gap through which the material is unwound from the roll.

27. The core according to claim 23, wherein:

the first core end support means is formed of a plastic material and is affixed to the core by adherence thereto with an adhesive material.

28. The core according to claim 27, wherein:

the sheet material comprises a plastic material.

29. The core according to claim 27, wherein:

the sheet material comprises a metal film.

30. The core according to claim 23, wherein:

the sheet material comprises a plastic material.

31. The core according to claim 23, wherein:

the sheet material comprises a metal film.

32. The core according to claim 20, wherein:

the first core end support means comprises a first multi-sectioned element having an elongate central axis, a first cylindrical section formed symmetric about said axis and having a first outer diameter sized to be closely fitted within the first end of the core to be permanently affixed thereat, a second coaxial cylindrical section formed to have a second outer diameter and an annular surface which is normal to said elongate axis and has a circularly arrayed set of radially oriented teeth, and a coaxial third cylindrical section having a toothed outer periphery having a third outer diameter, wherein said second diameter is larger than said first and third diameters;

wherein the second core end support means comprises an end cap closely fitted to the second end of the core and having a central coaxial outward extension with a distal end portion formed to be snap-fitted to an adjacent end of the lower cover of the dispenser body to be rotatably supported thereat, and a spring mounted to said outward extension so as to exert a compressive bias force against said adjacent end of the lower cover when said core and roll are placed within the dispenser body for use, wherein the means for controlling the direction of rotation of the core and roll cooperates with the radially oriented teeth of the first core end support means in a pawl and ratchet arrangement to limit the direction of rotation of the core and roll to enable unwinding of the sheet material from the roll while preventing inadvertent rewinding of the sheet material back onto the roll.

33. The core according to claim 32, wherein:

the third cylindrical section of the first core end means is rotatably supported to the lower cover of the dispenser body and has a length sufficient to allow an exposed portion thereof to project outwardly of the dispenser body to enable a user to grasp said exposed portion to rotate the same to override the means for controlling the direction of rotation of the core and roll and to thereby controllably rewind said sheet material back onto the roll.

34. The core according to claim 33, wherein:

the toothed outer periphery of the third cylindrical section of the core end support means is shaped, sized, and located so as to be totally clear of the means for stopping rotation of the core and roll when the gap between the upper and lower covers is held open under the action of the biasing means and so as to engage with the means for stopping rotation of the core and roll when the upper and lower covers are pivoted toward each other by a user in opposition to the biasing means.

35. The core according to claim 32 wherein:

the first core end support means is formed of a plastic material and is affixed to the core by adherence thereto with an adhesive material.

36. The core according to claim 35, wherein:

the sheet material comprises a plastic material.

37. The core according to claim 35, wherein:

the sheet material comprises a metal film.

38. The core according to claim 32, wherein:

the sheet material comprises a plastic material.

39. The core according to claim 32, wherein:

the sheet material comprises a metal film.

40. The core according to claim 20, wherein:

the first core end support means comprises a first multi-sectioned element having an elongate central axis, with a first cylindrical section formed symmetric about said axis and having a first outer diameter sized to closely fit around said first end of the core and a selected short length of the cylindrical outer surface of the core immediately adjacent thereto for permanent affixation thereat, a coaxial rim portion provided radially outward of said first end of the core, said rim portion comprising a coaxial second cylindrical section with a toothed outer periphery having a second outer diameter, a coaxial third cylindrical section also with a toothed outer periphery having a third outer diameter smaller than said second outer diameter, a central cap portion adjacent said received first end of the core, and a short central spindle extending outwardly of said cap portion, said spindle having a tapered distal end, wherein the second core end support means comprises an end portion of an inner surface of the core adjacent the second end thereof, wherein the first support means provides rotational support to the first core end support means at said spindle, and the second support means provides rotational support to the second core end support means by contacting the inner surface at said second end of the core, and the toothed outer periphery of the third cylindrical section cooperates with the means for controlling the direction of rotation of the core and roll in a pawl-and-ratchet arrangement to limit the direction of rotation of the core and roll to enable unwinding of the sheet material from the roll while preventing inadvertent rewinding of the sheet material back onto the roll.

41. The core according to claim 40, wherein:

the spindle is sized and shaped so that the tapered end thereof temporarily presses against and elastically deforms the first support means during placement of the core and roll into the dispenser body for subsequent use, the elastically deformed first support means being provided with an aperture sized and located to receive and rotatably support said spindle therein upon return of the first support means to an undeformed state.

42. The core according to claim 41, wherein:

the core and the first core end support means are shaped and sized so as to fit totally within the containment space defined by the upper and lower covers, and the sheet material as wound on the roll presents a width smaller than a corresponding length of the gap through which the material is unwound from the roll.

43. The core according to claim 40, wherein:

the toothed outer periphery of the second cylindrical section of the first core end support means is shaped, sized, and located so as to be totally clear of the means for stopping rotation of the core and roll when the gap between the upper and lower covers is held open under the action of the biasing means and so as to engage with the means for stopping rotation of the core and roll when the upper and lower covers are pivoted toward each other by a user in opposition to the biasing means.

44. The core according to claim 40, wherein:

the first core end support means is formed of a plastic material and is affixed to the core by adherence thereto with an adhesive material.

45. The core according to claim 44, wherein:

the sheet material comprises a plastic material.

46. The core according to claim 44, wherein:

the sheet material comprises a metal film.

47. The core according to claim 40, wherein:

the sheet material comprises a plastic material.

48. The core according to claim 40, wherein:

the sheet material comprises a metal film.

49. The core according to claim 20, wherein:

the first core end support means comprises a first core end support element having an elongate axis centrally of a flat circular central portion circumscribed by an annular-grooved rim, said rim having a toothed outer periphery of a first diameter larger than an outer diameter of said core and an inner toothed periphery having a diameter smaller than an inner diameter of said core, a circumferential groove being defined between said outer and inner toothed peripheries, said groove being sized to closely receive therein a first end and an immediately adjacent first end portion of the core to be permanently affixed thereat;

a circular hub having a central open cylindrical section with a central square inside bore provided with a small radially inward lip at a distal end of said bore, said cylindrical section having a circular base ending in a cylindrical rim sized to slidably fit into said inner toothed periphery of said first core end support element, said rim ending in a distal flange having an outer diameter sized to be intermediate the diameters of said outer and inner toothed peripheries of said first core end support element, said rim being provided with a pair of cuts defining therebetween a pawl which extends sufficiently to engage with the teeth of said inner toothed periphery of said first core end support element in a pawl-and-ratchet arrangement; and a compressive spring element having a first end pressed to a distal end surface of said cylindrical section of said hub, and a second end pressed to an inside surface of the first end wall of the lower cover so that said hub is slidably retained to said first wall of said lower cover but is continually biased away therefrom while said hub is retained within said inner toothed periphery of said rim and presses against said central portion thereof while rotatably supporting said rim and, simultaneously, providing said pawl-and-ratchet engagement between said pawl and the teeth of said inner toothed periphery of said first core end support element, wherein the second core end support means comprises an end portion of an inner surface of the core adjacent the second end thereof, wherein the first support means provides support to said spring and said hub and, via said hub, to said first core end support means, and the second support means provides support to the second core end support means by contacting the inner surface at said second end of the core, and wherein said pawl-and-ratchet arrangement limits the direction of rotation of the core and roll to enable unwinding of the sheet material from the roll while preventing inadvertent rewinding of the sheet material back onto the roll.

50. The core according to claim 49, wherein:

the core and the first core end support means are shaped and sized to fit totally within the containment space defined by the upper and lower covers, and the sheet material as wound on the roll presents a width smaller than a corresponding length of the gap through which the sheet material is unwound from the roll.

51. The core according to claim 49, wherein:

the toothed outer periphery of the first core end support means is shaped, sized, and located so as to be totally clear of the means for stopping rotation of the core end roll when the gap between the upper and lower covers is held open under the action of the biasing means and so as to engage with the means for stopping rotation of the core end roll when the upper and lower covers are pivoted toward each other by a user in opposition to the biasing means.

52. The core according to claim 44, wherein:

the first core end support means is formed of a plastic material and is affixed to the core by adherence thereto with an adhesive material.

53. The core according to claim 52, wherein:

the sheet material comprises a plastic material.

54. The core according to claim 52, wherein:

the sheet material comprises a metal film.

55. The core according to claim 52, wherein:

the hub comprises a plastic material.

56. The core according to claim 49, wherein:

the sheet material comprises a plastic material.

57. The core according to claim 49, wherein:

the sheet material comprises a metal film.

58. The core according to claim 20, wherein:

the first core end support means comprises a first multi-sectioned element having an elongate central axis, with a first cylindrical section formed symmetric about said axis and having a first outer diameter sized to be closely fitted within the first end of the core to be permanently affixed thereat, a coaxial second cylindrical section with a toothed outer periphery having a second outer diameter not less than an outside diameter of the core, and a coaxial third cylindrical section in the form of an elongate axial spindle, wherein the second core end support means comprises an end portion of the inner surface of the core adjacent the second end thereof, wherein the first support means provides support to the first core end support means at said spindle, and the second support means provides support to the second core end support means by contacting the inner surface at said second end of the core, and the means for controlling the direction of rotation of the core end roll cooperates with the toothed outer periphery of the coaxial second section in a pawl and ratchet arrangement to limit the direction of rotation of the core end roll to enable unwinding of the sheet material from the roll while preventing inadvertent rewinding of the sheet material back onto the roll.

59. The core according to claim 58, wherein:

the core and the first core end support means are shaped and sized so as to fit totally within the containment space defined by the upper and lower covers, and the sheet material as wound on the roll presents a width smaller than a corresponding length of the gap through which the sheet material is unwound from the roll.

60. The core according to claim 58, wherein:

the toothed outer periphery of the second cylindrical section of the first core end support means is shaped, sized, and located so as to be totally clear of the means for stopping rotation of the core end roll when the gap between the upper and lower covers is held open under the action of the biasing means and so as to engage with the means for stopping rotation of the core end roll when the upper and lower covers are pivoted toward each other by a user in opposition to the biasing means.

61. The core according to claim 58, wherein:

the first core end support means is formed of a plastic material and is affixed to the core by adherence thereto with an adhesive material.

62. The core according to claim 61, wherein:

the sheet material comprises a plastic film.

63. The core according to claim 61, wherein:

the sheet material comprises a metal film.

64. The core according to claim 58, wherein:

the sheet material comprises a plastic material.

65. The core according to claim 58, wherein:

the sheet material comprises a metal film.

66. The core according to claim 58, wherein:

the means for controlling the direction of rotation of the core end roll cooperates with the teeth of the second cylindrical portion of the first core end support means in a pawl and ratchet arrangement to limit the direction of rotation of the core end roll to enable unwinding of the sheet material from the roll while preventing inadvertent rewinding of the sheet material back onto the roll.

67. Apparatus for dispensing selected lengths of a sheet material, comprising:

an elongate hollow core having first and second ends and a generally cylindrical outer surface therebetween on which a length of the sheet material is wound to form a roll, first core end support means located at the first end of the core, and second core end support means located at the second end of the core; and a dispenser body replaceably receiving said core with said sheet material wound thereon, said dispenser body comprising an upper cover pivotally connected to a lower cover to define a containment space for containing the roll and core therebetween and an elongate material delivery gap of adjustable width defined between respective front edges of the upper and lower covers so that a free end of the sheet material unwound from the roll is accessible through the material delivery gap, first support means located inside the containment space adjacent to respective first end walls of the upper and lower covers for rotatably supporting the first end of the core in cooperation with the first core end support means, second support means located inside the containment space adjacent to respective second end walls of the upper and lower covers for rotatably supporting the second end of the core by cooperating with the second core end support means, biasing means for resiliently biasing apart the upper and lower covers, separation limiting means for limiting an extent of said pivotal biasing apart between the upper and lower covers so as to limit said gap, and rotation stopping means cooperating with said first core end support means for stopping rotation thereof to thereby limit an amount of the material unrolled from the roll through the material delivery gap.

68. The apparatus according to claim 67, further comprising:

core rotation-direction limiting means, cooperating with the first core support means to limit a rotation of the core within the dispenser body to a rotation in a selected direction around a core axis.

69. The apparatus according to claim 67, further comprising:

tear means disposed adjacent a front edge of said lower cover for initiating a tear in said sheet material when said sheet material is forcibly contacted thereto.

70. The apparatus according to claim 67, wherein:

the lower cover has an elongate shelf portion extending between said containment space and a front edge of said lower cover, and a front edge of the upper cover extends over the elongate shelf portion and is disposed to be located inwardly of the front edge of the lower cover, whereby a distal end portion of the sheet material extends over the shelf portion between the respective front edges of the upper and lower covers and is thereby positioned to be readily accessible by a user.

71. The apparatus according to claim 67, wherein:

said first and second covers are formed of a molded plastic material and are pivotally connected to each other by a hinge mechanism, and the biasing means comprises a length of material integral with the lower cover and shaped and disposed so as to resiliently press against an inner surface of the upper cover to exert a bias force constantly acting to separate the upper and lower covers pivotally apart.

72. The apparatus according to claim 67, wherein:

said rotation stopping means comprises an extended element provided at said upper cover so as to totally clear said core when the material delivery gap is held open by said biasing means pivotally separating said upper and lower covers and which engages with said first core end support means to stop rotation thereof and of the core and roll wound thereon when the upper and lower covers are pivotally pressed to each other.

73. The apparatus according to claim 67, wherein:

the separation limiting means comprises a detent element mounted to one of the upper and lower covers, and a detent element engagement element provided at the other of the upper and lower covers so as to engage with the detent element when the upper and lower covers are pivoted toward each other against a biasing force provided by the biasing means, the engagement being maintained so as to permit a predetermined pivotal separation between the upper and lower covers to thereby limit an opening of the material delivery gap.

74. The apparatus according to claim 67, wherein:

said elongate hollow core comprises a hollow cardboard cylinder, and said first core end support means comprises a first plastic material, and said upper and lower covers are both made of a second plastic material, with said biasing means being formed integral with said lower cover.

75. The apparatus according to claim 74, wherein:

said sheet material comprises one of a plastic material film and a film containing metal.

76. The apparatus according to claim 75, wherein:

said rotation stopping means comprises an extended element integral with said upper cover, and said detent means comprises a detent element integral with said upper cover and said detent element engagement element is integral with said lower cover.

77. The apparatus according to claim 76, further comprising:

core rotation-direction limiting means, cooperating with the first core support means to limit a rotation of the core within the dispenser body to a rotation in a selected direction around a core axis; and tear means disposed adjacent a front edge of said lower cover for initiating a tear in said sheet material when said sheet material is forcibly contacted thereto.

78. A method for containing a replaceable hollow cylindrical roll of a sheet material wound on a core provided with a first core end support means at a first end and a second core end support means at a second end, and for enabling safe extraction from the roll of selected lengths of the sheet material by a user, comprising the steps of:

providing a dispenser body comprising an upper cover pivotally connected to a lower cover to define a containment space containing the roll and core therebetween and an elongate material delivery gap of adjustable width defined between respective front edges of the upper and lower covers so that a free end of the sheet material unwound from the roll is accessible through the material delivery gap, first support means located inside the containment space adjacent to respective first end walls of the upper and lower covers for rotatably supporting the first end of the core in cooperation with the first core end support means, second support means located inside the containment space adjacent to respective second end walls of the upper and lower covers for rotatably supporting the second end of the core by cooperating with the second core end support means, biasing means for resiliently biasing apart the upper and lower covers, separation limiting means for limiting an extent of said pivotal biasing apart between the upper and lower covers so as to limit said gap, tear means adjacent the front edge of the lower cover, and rotation stopping means cooperating with said first core end support means for stopping rotation thereof to thereby limit an amount of the material unrolled from the roll through the material delivery gap;

grasping the dispenser body such that the upper and lower cover thereof continue to be pivotally separated by the biasing means;

grasping a distal end of the sheet material and pulling a desired length thereof through the material delivery gap;

pressing the upper and lower covers to each other in opposition to the biasing means, to activate the rotation stopping means and thereby prevent further rotation of the core and roll wound thereon; and pressing the unwound sheet material to the tearing means to tear off the sheet material thereat.

79. The method according to claim 78, wherein:

upon exhaustion of the sheet material from a roll in the dispenser body, releasing the upper and lower covers at said separation limiting means thereof and pivotally separating the upper and lower covers to open the containment space therebetween;

removing the core from which the sheet material has been exhausted;

putting in a replacement core with sheet material wound thereon, so that the first core and support means is placed to be rotatably supported by the first support means and the second core end support means is placed to be rotatably supported by the second support means; and pivotally rotating the upper cover to the second cover and obtaining engagement of the first and second covers by the separation limiting means.

80. Apparatus for containing a replaceable roll of a sheet material and for enabling controlled removal of selected lengths of the sheet material wound on a hollow core having first and second ends and first and second core end support means provided respectively thereat, comprising:

an upper cover pivotally connected to a lower cover, the upper and lower covers each comprising an elongate wall having respective front and rear edges and transverse first and second end walls, the upper and lower covers each being shaped and sized to cooperatively define a containment space for containing the roll and core therebetween, a free end of the sheet material unwound from the roll being accessible through an elongate material delivery gap of adjustable width between the front edges of the upper and lower covers;

first support means located inside the containment space adjacent to the first end walls of the upper and lower covers for rotatably supporting a first end of the core by cooperating with the first core end support means;

second support means located inside the containment space and adjacent to the second end walls of the upper and lower covers for rotatably supporting a second end of the core by cooperating with the second core end support means;

biasing means for resiliently biasing the upper and lower covers to pivotally separate them apart; and separation limiting means for limiting an extent of a pivotal separation between the upper and lower covers by the biasing means, wherein the containment space defined by the upper and lower covers is substantially cylindrical in shape, the lower cover has an elongate shelf portion extending outwardly of said substantially cylindrical containment space to the front edge of the lower cover, and the front edge of the upper cover extends over the elongate shelf portion and is disposed to be located inwardly of the front edge of the lower cover, whereby a distal end portion of the sheet material extends over the shelf portion between the respective front edges of the upper and lower covers and is thereby positioned to be readily accessible by a user.

81. The apparatus according to claim 80, wherein:

the biasing means comprises a spring element mounted to one of the upper and lower covers and disposed so as to exert a biasing force on the other of said first and second covers so as to cause a pivotal separation between the first and second covers.

82. The apparatus according to claim 80, wherein:

the separation limiting means comprises a detent element mounted to one of the upper and lower covers, and a detent element engagement element provided at the other of the upper and lower covers so as to engage with the detent element when the upper and lower covers are pivoted toward each other against a biasing force provided by the biasing means, the engagement being maintained so as to permit a predetermined pivotal separation between the upper and lower covers to thereby limit an opening of the material delivery gap.

83. The apparatus according to claim 80, further comprising:

core rotation-direction limiting means, cooperating with the first core end to limit a rotation of the core to a rotation in a selected direction around a core axis.

84. The apparatus according to claim 80, further comprising:

rotation stopping means for stopping rotation of the core to limit an amount of the material unrolled from the roll via the material delivery gap; and tears means disposed adjacent said front edge of said lower cover for initiating a tear in said sheet material when said sheet material is forcibly contacted thereto.

85. The apparatus according to claim 89, wherein:

said rotation stopping means comprises an extended element provided at said upper cover so as to totally clear said core when the material delivery gap is held open by said biasing means pivotally separating said upper and lower covers and which engages with said core to stop rotation thereof when the upper and lower covers are pivotally pressed to each other.

86. The apparatus according to claim 85, further comprising:

means for preventing operational contact between the tear means and the sheet material until the upper and lower covers are pressed to each other.

87. The apparatus according to claim 86, wherein:

the tear means comprises a longitudinal element with a serrated tearing edge, mounted along the front edge of the lower cover; and the means for preventing operational contact comprises a substantially flat elongate guard element pivotally mounted to a front portion of the lower cover, with a resilient element disposed to bias a front edge portion of an upper surface of the guard element to a position above the serrated tearing edge, wherein the upper cover is formed to contact the upper surface of the guard element so as to press the front edge portion of the upper surface thereof below the serrated tearing edge when the upper and lower covers are pivotally pressed to each other sufficiently to overcome the bias of the resilient element, whereby an operational contact between the sheet material and the serrated tearing edge is enabled.

88. The apparatus according to claim 87, wherein:

the guard element is made of a plastic material and is hinged at opposite ends to the lower cover; and the resilient element is formed integrally with the lower cover.

89. The apparatus according to claim 88, wherein:

said first and second covers are formed of a molded plastic material and are pivotally connected to each other by a hinge mechanism;

the biasing means comprises a length of material integral with the lower cover and is shaped and disposed so as to resiliently press against an inner surface of the upper cover to exert a bias force constantly acting to pivotally separate the upper and lower covers apart; and the separation limiting means comprises a detent element integral with one of the upper and lower covers, and a detent element engagement element integral with the other of the upper and lower covers and disposed so as to engage with the detent element when the upper and lower covers are pivoted toward each other against a biasing force provided by the biasing means, the engagement being maintained so as to permit a predetermined pivotal separation between the upper and lower covers to thereby limit an opening of the material delivery gap.

90. The apparatus according to claim 89, further comprising:

core rotation-direction limiting means, cooperating with the first core end to limit a rotation of the core to a rotation in selected direction around a core axis; and wherein said detent element is formed integrally with one of the upper and lower covers and the detent element engagement element is formed integrally with the other of said upper and lower covers, said core rotation-direction limiting means comprises an element formed integrally with said lower cover, and said extended element of said rotation stopping means is formed integrally with said upper cover.

91. The apparatus according to claim 90, wherein:

said upper and lower covers are formed of a molded plastic material and are pivotally connected to each other by a hinge mechanism.

92. The apparatus according to claim 80, wherein:

said upper and lower covers are formed of a molded plastic material and are pivotally connected to each other by a hinge mechanism.

93. The apparatus according to claim 80, wherein:

the biasing means comprises a length of material integral with the lower cover and shaped and disposed so as to resiliently press against an inner surface of the upper cover to exert a bias force constantly acting to pivotally separate the upper and lower covers apart.

94. The apparatus according to claim 80, wherein:

said upper and lower covers are formed of a molded plastic material and are pivotally connected to each other by a hinge mechanism;

the biasing means comprises a length of material integral with the lower cover and is shaped and disposed so as to resiliently press against an inner surface of the upper cover to exert a bias force constantly acting to pivotally separate the upper and lower covers apart; and the separation limiting means comprises a detent element integral with one of the upper and lower covers, and a detent element engagement element integral with the other of the upper and lower covers and disposed so as to engage with the detent element when the upper and lower covers are pivoted toward each other against a biasing force provided by the biasing means, the engagement being maintained so as to permit a predetermined pivotal separation between the upper and lower covers to thereby limit an opening of the material delivery gap.

95. The apparatus according to claim 94, wherein:

the containment space defined by the upper and lower covers is substantially cylindrical in shape, the lower cover has an elongate shelf portion extending outwardly of said substantially cylindrical containment space to the front edge of the lower cover, and the front edge of the upper cover extends above the elongate shelf portion and is disposed to be located inwardly of the front edge of the lower cover, whereby a distal end portion of the sheet material extends over the shelf portion between the respective front edges of the upper and lower covers and is thereby positioned to be readily accessible by a user.

96. The apparatus according to claim 95, further comprising:

core rotation-direction limiting means, cooperating with the first core end to limit a rotation of the core to rotation in a selected direction about a core axis; and tear means disposed adjacent said front edge of said lower cover for initiating a tear in said sheet material when said sheet material is forcibly contacted thereto.

97. The apparatus according to claim 96, wherein:

said detent element is formed integrally with one of the upper and lower covers and the detent element engagement element is formed integrally with the other of said upper and lower covers;

said core rotation-direction limiting means comprises an element formed integrally with said lower cover; and said extended element of said rotation stopping means is formed integrally with said upper cover.

* * * * *